US010418012B2

(12) United States Patent
Katz

(10) Patent No.: US 10,418,012 B2
(45) Date of Patent: Sep. 17, 2019

(54) TECHNIQUES FOR DYNAMIC MUSIC PERFORMANCE AND RELATED SYSTEMS AND METHODS

(71) Applicant: Symphonova, Ltd., London (GB)

(72) Inventor: Shelley Katz, Bexhill on Sea (GB)

(73) Assignee: Symphonova, Ltd., London (GB)

( * ) Notice: Subject to any disclaimer, the term of this patent is extended or adjusted under 35 U.S.C. 154(b) by 0 days.

(21) Appl. No.: 16/065,434

(22) PCT Filed: Dec. 22, 2016

(86) PCT No.: PCT/EP2016/082492
§ 371 (c)(1),
(2) Date: Jun. 22, 2018

(87) PCT Pub. No.: WO2017/109139
PCT Pub. Date: Jun. 29, 2017

(65) Prior Publication Data

US 2019/0012997 A1 Jan. 10, 2019

Related U.S. Application Data

(60) Provisional application No. 62/387,388, filed on Dec. 24, 2015.

(51) Int. Cl.
*G10H 1/40* (2006.01)
*G10H 1/36* (2006.01)
(Continued)

(52) U.S. Cl.
CPC ..... *G10H 1/361* (2013.01); *G10H 1/0008* (2013.01); *G10H 1/045* (2013.01); *G10H 1/40* (2013.01);
(Continued)

(58) Field of Classification Search
CPC ..... G10H 1/361; G10H 1/045; G10H 1/0008; G10H 1/40; G10H 2220/201; G10H 2220/395; G10H 2210/076
(Continued)

(56) References Cited

U.S. PATENT DOCUMENTS 5,142,961 A * 9/1992 Paroutaud ..... G10F 1/00 84/2
5,315,060 A * 5/1994 Paroutaud ..... G10F 1/00 84/11
(Continued)

FOREIGN PATENT DOCUMENTS

EP 2407957 A2 1/2012
EP 2571016 A2 3/2013
(Continued)

OTHER PUBLICATIONS

International Search Report and Written Opinion for International Application No. PCT/IB2015/002019 dated Feb. 19, 2016.
(Continued)

*Primary Examiner* — Jeffrey Donels
(74) *Attorney, Agent, or Firm* — Wolf, Greenfield & Sacks, P.C.

(57) ABSTRACT

According to some aspects, an apparatus is provided for controlling the production of music, the apparatus comprising at least one processor, and at least one processor-readable storage medium comprising processor-executable instructions that, when executed, cause the at least one processor to receive data indicative of acceleration of a user device, detect that the acceleration of the user device has exceeded a predetermined threshold based at least in part on the received data, determine that no beat point has been triggered by the apparatus for at least a first period of time, and trigger a beat point in response to detecting that the acceleration of the user device has exceeded the predeter-
(Continued)

mined threshold and determining that no beat point has been triggered for at least the first period of time.

18 Claims, 16 Drawing Sheets

(51) Int. Cl.
*G10H 1/045* (2006.01)
*G10H 1/42* (2006.01)
*G10H 1/00* (2006.01)

(52) U.S. Cl.
CPC ..... *G10H 1/42* (2013.01); *G10H 2210/076* (2013.01); *G10H 2220/201* (2013.01); *G10H 2220/206* (2013.01); *G10H 2220/395* (2013.01)

(58) Field of Classification Search
USPC ..... 84/635
See application file for complete search history.

(56) References Cited

U.S. PATENT DOCUMENTS

| | | | | |
|---|---|---|---|---|
| 5,663,514 | A * | 9/1997 | Usa | G10H 1/0008 84/600 |
| 8,119,898 | B2 * | 2/2012 | Bentson | G10G 1/00 84/609 |
| 8,666,695 | B2 | 3/2014 | Han et al. | |
| 8,990,042 | B2 | 3/2015 | Han et al. | |
| 9,418,636 | B1 * | 8/2016 | Malluck | G10F 1/12 |
| 2002/0170413 | A1 | 11/2002 | Nishitani et al. | |
| 2006/0023898 | A1 | 2/2006 | Katz | |
| 2009/0320669 | A1 * | 12/2009 | Piccionelli | G10H 1/0058 84/609 |
| 2012/0275613 | A1 | 11/2012 | Soulodre | |

FOREIGN PATENT DOCUMENTS

| | | | |
|---|---|---|---|
| EP | 2793221 | A1 | 10/2014 |
| EP | 2919385 | A1 | 9/2015 |
| JP | 2008-292739 | A | 12/2008 |
| JP | 2010-066640 | A | 3/2010 |
| WO | WO 2014/199613 | A1 | 12/2014 |

OTHER PUBLICATIONS

International Preliminary Report on Patentability for International Application No. PCT/IB2015/002019 dated Mar. 30, 2017.
International Search Report and Written Opinion for International Application No. PCT/EP2016/082492 dated May 12, 2017.
International Preliminary Report on Patentability for International Application No. PCT/EP2016/082492 dated Jul. 5, 2018.
Hopper, Reverberation Enhancement for Small Rooms. Doctoral Thesis. University of Southampton. Jan. 2012. 174 pages.
Nagatomo et al., Variable reflection acoustic wall system by active sound radiation. Acoustical Science and Technology. 2007:84-9.
Nakra et al., The UBS Virtual Maestro: an Interactive Conducting System. NIME. 2009. 6 pages.

* cited by examiner

610
Instrumental Loudspeaker - String Instrument

TECHNIQUES FOR DYNAMIC MUSIC PERFORMANCE AND RELATED SYSTEMS AND METHODS

CROSS-REFERENCE TO RELATED APPLICATIONS

This Application is a national stage filing under 35 U.S.C. 371 of International Patent Application Serial No. PCT/EP2016/082492, filed Dec. 22, 2016, entitled "TECHNIQUES FOR DYNAMIC MUSIC PERFORMANCE AND RELATED SYSTEMS AND METHODS", which claims priority to U.S. Application Ser. No. 62/387,388, filed Dec. 24, 2015, entitled "TECHNIQUES FOR LIVE MUSIC PERFORMANCE AND RELATED SYSTEMS AND METHODS". The contents of these applications are incorporated herein by reference in their entirety.

BACKGROUND

Acoustic instrumental musicians and singers who perform in large groups do not generally perform in small venues, especially outside of urban centers. The challenge of paying for a large number of musicians from the revenue generated by a small audience in such a small venue, combined with the difficulty of fitting a large group of performers (e.g., orchestral players combined with a large choir) onto a small stage generally eliminate such a performance from reasonable consideration.

SUMMARY

According to some aspects, an apparatus is provided for controlling the production of music, the apparatus comprising at least one processor, and at least one processor-readable storage medium comprising processor-executable instructions that, when executed, cause the at least one processor to receive data indicative of acceleration of a user device, detect whether the acceleration of the user device has exceeded a predetermined threshold based at least in part on the received data, determine whether a beat point has been triggered by the apparatus within a prior period of time, and trigger a beat point when the acceleration of the user device is detected to have exceeded the predetermined threshold and when no beat point is determined to have been triggered during the prior period of time.

According to some embodiments, the processor-executable instructions, when executed by the at least one processor, further cause the at least one processor to generate acoustic data according to a digital musical score in response to the beat point trigger.

According to some embodiments, a tempo of the acoustic data generated according to the digital musical score is determined based at least in part on a period of time between triggering of a previous beat point and said triggering of the beat point.

According to some embodiments, generating the acoustic data according to the musical score comprises identifying an instrument type associated with a portion of the musical score, and generating the acoustic data based at least in part on the identified instrument type.

According to some embodiments, the processor-executable instructions, when executed by the at least one processor, further cause the at least one processor to output the generated acoustic data to one or more instrumental loudspeakers of the identified instrument type.

According to some embodiments, the processor-executable instructions, when executed by the at least one processor, further cause the at least one processor to output the generated acoustic data to one or more loudspeakers.

According to some embodiments, the prior period of time is a period of between 200 ms and 400 ms immediately prior to said determination of whether the beat point has been triggered.

According to some embodiments, the apparatus further comprises at least one wireless communication interface configured to receive said data indicative of acceleration of the user device.

According to some aspects, an orchestral system is provided, comprising a plurality of instrumental loudspeakers, each instrumental loudspeaker being an acoustic musical instrument comprising at least one transducer configured to receive acoustic signals and to produce audible sound from the musical instrument in accordance with the acoustic signals, a computing device comprising at least one computer readable medium storing a musical score comprising a plurality of sequence markers that each indicate a time at which playing of one or more associated sounds is to begin, and at least one processor configured to receive beat information from an external device, generate, based at least in part on the received beat information, acoustic signals in accordance with the digital score by triggering one or more of the sequence markers of the musical score and producing the acoustic signals as corresponding to one or more sounds associated with the triggered one or more sequence markers, and provide the acoustic signals to one or more of the plurality of instrumental loudspeakers.

According to some embodiments, the acoustic signals are generated based at least in part on instrument types associated with the one or more sounds of the musical score.

According to some embodiments, the plurality of instrumental loudspeakers includes at least a first instrument type, and acoustic signals provided to the instrumental loudspeakers of the first instrument type are generated based at least in part on one or more sounds of the musical score associated with the first instrument type.

According to some embodiments, the orchestral system further comprises one or more microphones configured to capture audio and supply the audio to the computing device, and the at least one processor of the computing device is further configured to receive the captured audio and provide the captured audio to one or more of the plurality of instrumental loudspeakers.

According to some embodiments, the one or more microphones are mounted to one or more acoustic musical instruments, and the at least one processor of the computing device is further configured to perform digital signal processing upon the captured audio before providing the captured audio to the one or more of the plurality of instrumental loudspeakers.

According to some embodiments, the at least one processor of the computing device is further configured to output a prerecorded audio recording to one or more of the plurality of instrumental loudspeakers.

According to some embodiments, the orchestral system further comprises at least one microphone configured to capture ambient sound within a listening space, a diffuse radiator loudspeaker configured to produce incoherent sound waves, and a reverberation processing unit configured to apply reverberation to at least a portion of ambient sound captured by the at least one microphone, thereby producing modified sound, and output the modified sound into the listening space via the diffuse radiator loudspeaker.

According to some aspects, a method is provided of controlling the production of music, the method comprising receiving, by an apparatus, data indicative of acceleration of a user device, detecting, by the apparatus, that the acceleration of the user device has exceeded a predetermined threshold based at least in part on the received data, determining, by the apparatus, that no beat point has been triggered by the apparatus for at least a first period of time, and triggering, by the apparatus, a beat point in response to said detecting that the acceleration of the user device has exceeded the predetermined threshold and said determining that no beat point has been triggered for at least the first period of time.

According to some embodiments, the method further comprises generating, by the apparatus, acoustic data according to a digital musical score in response to the beat point trigger.

According to some embodiments, the method further comprises producing sound from one or more instrumental loudspeakers according to the generated acoustic data, and the one or more instrumental loudspeakers are each an acoustic musical instrument comprising at least one transducer configured to receive acoustic signals and to produce audible sound from the musical instrument in accordance with the acoustic signals.

According to some embodiments, the first period of time is between 200 ms and 400 ms.

The foregoing apparatus and method embodiments may be implemented with any suitable combination of aspects, features, and acts described above or in further detail below. These and other aspects, embodiments, and features of the present teachings can be more fully understood from the following description in conjunction with the accompanying drawings.

BRIEF DESCRIPTION OF DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

DETAILED DESCRIPTION

Figure 1:
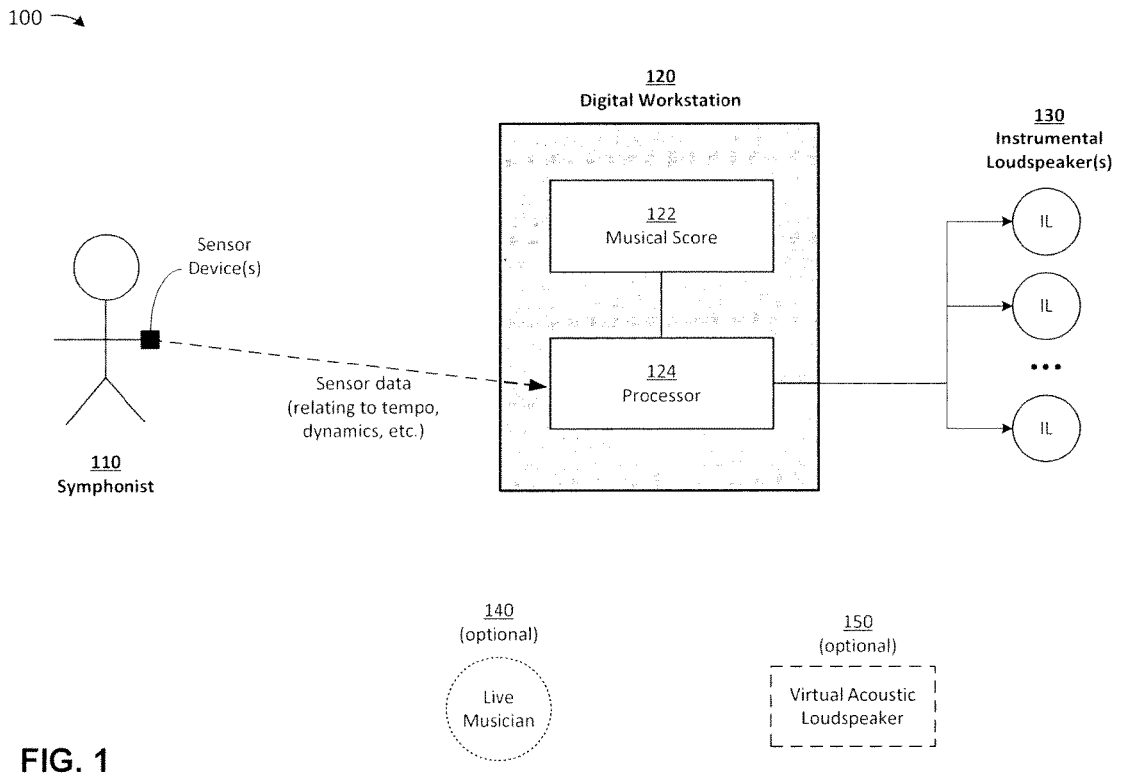
FIG. 1 depicts an illustrative Symphonova system, according to some embodiments.

Live acoustic instrumental musicians and singers are typically limited to particular performance venues due to constraints of acoustics, space and/or expense. For instance, large concert halls are typically only used by groups that are large enough in number to produce sufficient sound to fill the acoustics of the hall. While some groups may wish to perform in smaller venues, such venues may exhibit inferior acoustics, may have insufficient space to accommodate the performers, and/or may be unable to seat a large enough audience to make such performances financially worthwhile. While small groups may have greater flexibility when choosing a venue for performances, the repertoire available for small groups limits the performers to works that are more fitting in small venues, and the more limited repertoire generally does not include most of the works that draw audiences. These concerns reduce the opportunities for acoustic musicians to perform in public, and consequently make acoustic music, and in particular orchestral music, less accessible to audiences.

The inventor has recognized and appreciated techniques for dynamically producing acoustic music that enable a greater number of musicians to perform live acoustic music and that greatly expand the types of performance spaces available to those musicians. These techniques may utilize a digital musical score that is dynamically controlled by one or more devices that are held and/or worn by a conductor. These devices allow the conductor to conduct a group of musicians in the conventional manner whilst the conductor's movements simultaneously provide control signals to the digital musical score, which dynamically produces additional sound as a result. This system is referred to herein as the "Symphonova" (or, alternatively, "Symphanova").

According to some embodiments, the Symphonova system may include a number of "instrumental loudspeakers" designed to produce sound that mimics a live musician (e.g., a violinist, a vocalist, etc.). The system may, in at least some cases, also include one or more live musicians. An instrumental loudspeaker may be controlled to reproduce sound captured from live musicians or may be controlled to produce prerecorded and/or computer-generated sound. A Symphonova system may, in general, include any number of live musicians and instrumental loudspeakers each producing sound via these techniques.

The inventor has recognized and appreciated that an effective way to create the sound and/or individual character of an acoustic instrument is to use the instrument itself as a loudspeaker. As such, an instrumental loudspeaker utilizes an instance of a particular instrument type (e.g., violin, double bass, trumpet, flute, etc.) modified with a transducer that enables propagation of sound from the instrument. Music played from, for example, a violin used as an instrumental loudspeaker in this manner has a sound and/or character much closer to that of a live violin player than would a conventional loudspeaker playing the same music.

According to some embodiments, an instrumental loudspeaker may play music captured from a live performer in the same venue, or in a different location. For instance, one or more microphones may capture sound from a live violinist and that sound may be played through one or more violin instrumental loudspeakers. In this manner, a solo musician may produce sound that would usually require a number of live musicians. In some use cases, sound captured from a live musician may be processed before being played through an instrumental loudspeaker so that there are differences between the live sound and the sound played through the instrumental loudspeaker. This allows the combination of live musician and instrumental loudspeaker to more convincingly simulate a pair of live musicians, especially where the differences in sound are comparatively subtle. Where a number of instrumental loudspeakers play music captured from a single live musician, the music may be processed in a number of different ways so that the instrumental loudspeakers each play a version of the music that has experienced different processing.

According to some embodiments, instrumental loudspeakers may play music output from a digital musical score. As discussed above, a digital musical score may be dynamically controlled by one or more devices that are held and/or worn by a conductor. These motions may be interpreted by a computing device, which produces sound according to the digital musical score and the motions. For instance, a sequencer may be configured to play a musical piece and the tempo and/or dynamics of the sequencer may be defined by the motions of the conductor. A digital musical score may utilize computer generated sounds (e.g., synthesized sounds) and/or prerecorded sounds (e.g., a recording of a violin playing a "D") in producing music.

According to some embodiments, a Symphonova system may include any number of "virtual acoustic loudspeakers" through which the system can control reverberatory properties (e.g., early and late reflections) of the listening space. The inventor has recognized and appreciated that, even with a combination of live musicians and instrumental loudspeakers, some performance spaces may nonetheless have inferior acoustics for orchestral music. As a result, the inventor has developed techniques for dynamically controlling the resonant acoustics of a listening space. These techniques, combined with the dynamic production of music via the control of a digital musical score as described above, have the potential to convincingly simulate a large orchestra within a large concert hall, even with a relatively small number of live musicians in a relatively small space.

FIG. 1 depicts an illustrative Symphonova system, according to some embodiments. System 100 includes a digital workstation 120 coupled to one or more instrumental loudspeakers 130. As discussed above, an instrumental loudspeaker is an actual acoustic instrument configured with one or more transducers and an appropriate interface to enable an audio signal of the specific instrument to be propagated by the acoustic instrument when it is induced to do so by the transducer. A digital musical score 122 stored by, or otherwise accessible to, the digital workstation defines how to generate music. This music may be produced according to control signals produced by the Symphonist 110 and output by one of more of the instrumental loudspeakers 130.

In the example of FIG. 1, the Symphonist 110 wears and/or holds one or more sensor devices, which provide data indicating to the digital workstation how it is to produce music according to the musical score 122. This data may indicate any musical characteristic(s), such as tempo, dynamics, etc. The system 100 may optionally include one or more live musicians 140 and/or one or more virtual acoustic loudspeakers 150. Each of these components are discussed in further detail below.

As discussed above, the techniques described herein allow a conductor to conduct a group of musicians in a conventional manner whilst the conductor's movements simultaneously provide control signals to a digital musical score. Conventionally, live musicians will produce music according to the motions of a conductor by interpreting his motions and using those interpretations to inform their playing of music. The movements of a conductor, which often include the motion of a baton, primarily convey tempo and musical phrasing to musicians, although more subtle movements by expert conductors can serve to direct subgroups of the musicians whilst also unifying the group as a whole.

For instance, musical expression can be created through the alteration of timing under the direction of the conductor. Even very small adjustments in timing can enable or prevent superior/artistic expression, which may be produced by slowing down or speeding up frequently and in a flexible manner. This fluid adjustment of tempo is sometimes referred to as 'tempo rubato,' and many orchestras are attuned and practiced in this skill. By way of example, in the aria Stridono Lassu by Pagliacci, after the word 'Segguon' there is a pause of indeterminate length on the ' . . . guon' portion of the word, because the soprano will hold the note for expressive purposes. Although a skilled orchestra, if they practice the moment sufficiently with the soprano, may indeed be able to perform the moment without mishap, it can risky to perform correctly, especially if the soprano suddenly decides in performance to significantly shorten or lengthen her pause on the note, because the orchestra must collectively decide to begin playing at the same, indeterminate moment. In this situation, an expressive musical moment may be impossible without the coordinating gestures of the conductor.

Co-ordinated performance at crucial moments are often those moments that are the most apparent to audiences. For example, the opening of Beethoven's 5th symphony, or the accelerando (speeding up) transition between the 3rd and 4th movement in the same symphony, or virtually any accompanied recitative, all require very precise ensemble in the orchestra. Where the music requires only a very small ensemble of players, it may be possible to stay coordinated in exposed moments, but once the ensemble gets beyond a handful of players, it becomes very difficult or impossible for the players to have precise starts and stops, combined with flexibility in performance, without a conductor's clear indications.

In part due to the importance of the motions of a conductor to musical performance, the inventor has recognized and appreciated technology that allows the conductor to direct musicians in substantially the same manner as a conventional conductor whilst those same motions also convey control information to a digital workstation that produces music according to a digital musical score. Such a conductor is referred to in the example of FIG. 1 and below as a "Symphonist," to distinguish this individual from a conventional conductor.

According to some embodiments, the Symphonist 110 may wear and/or hold one or more devices whose motion produces control data relating to tempo. As referred to herein, "tempo" refers at least to musical characteristics such as beat pacing, note onset timing, note duration, dynamical changes, and/or voice-leading, etc. As discussed above, the motions of the devices to produce such data may also be those of conventional movements of a conductor to convey tempo to live musicians. For instance, a baton comprising one or more accelerometers may provide the function of a conventional baton whilst producing sensor data that may be used to control production of music via the musical score 122. In general, devices that produce control data relating to tempo may include sensors whose motion generates data indicative of the motion, such as but not limited to, one or more accelerometers and/or gyroscopes.

According to some embodiments, devices that produce control data relating to tempo may comprise detectors external to the Symphonist that register the movements of the Symphonist, such as one or more cameras and/or other photodetectors that capture at least some aspects of the Symphonist's movements. Such external detectors may, in some use cases, register the Symphonist's movements at least in part by tracking the motion of a recognizable object held and/or worn by the Symphonist, such as a light, a barcode, etc.

As will be discussed further below, one important element of a conductor's 'beat' is the moment in the gesture when there is a change of angular direction. Most conductors place their beat so that, as a visual cue, it is located at the bottom of a vertical gesture, although many place it at the top of a vertical gesture ("vertical" refers to a direction that is generally perpendicular to the ground, or parallel to the force of gravity), and some outliers place the 'beat' elsewhere or nowhere. According to some embodiments, digital workstation 120 may be configured to identify a gesture conveying a beat based on sensor data received from the one or more devices of the Symphonist (whether held and/or worn by the Symphonist and/or whether external tracking devices), and to produce music according to the digital musical score 122 using a tempo implied by a plurality of identified beats (e.g., two sequential beats).

According to some embodiments, the Symphonist may wear and/or hold one or more devices whose motion produces control data relating to dynamics. As referred to herein, "dynamics" refers at least to musical characteristics such as variations in loudness, timbre, and/or intensity, etc.

According to some embodiments, the Symphonist may wear a device and/or hold a device that senses movement of a part of the Symphonist's body, such as a forearm or wrist, and produces pitch data corresponding to the movement. Said pitch data may include data representative of motion around any one or more axes (e.g., may include pitch, roll and/or yaw measurements). As an example, a device having one or more gyroscopes may be affixed to the underside of the Symphonist's forearm so that the motion of the forearm can be measured as the Symphonist raises and lowers his arm. Thereby, by raising and lowering the arm, control data relating to dynamics may be provided to the digital workstation 120. This may produce, for example, dynamic adjustment of the volume of music produced by the digital workstation by raising and lowering of the arm. The dynamics information may be independent of control information relating to tempo. Accordingly, a Symphonist could, for example, conduct using a baton providing control data defining tempo whilst also making additional motions that produce dynamics control data. Where motion around multiple axes is detected, the motion around the different axes may control different aspects of dynamics. For instance, pitch may control loudness while yaw may control timbre.

According to some embodiments, when detecting motion of a Symphonist by one or more sensor devices and generating control data relating to dynamics, the determination of a dynamical response may be based on relative, not absolute movement of the Symphonist. In some cases, the Symphonist may initiate a motion to alter the dynamics from a completely different position from a position where the Symphonist last altered the dynamics. For instance, the Symphonist may begin a gesture to cue for a reduction in volume with his arm raised to a first height, yet may have previously increased the volume to its current level by raising the arm to a height lower than the first height. If the control data were interpreted to adjust the volume based on the absolute height of the arm, the volume might be controlled to increase rapidly (because of the higher, first height being signaled) before the new gesture to reduce the volume were respected. As such, the digital workstation and/or sensor devices may produce and/or analyze control data based on relative motion. In some cases, this may involve a sensor that simply measures the difference in motion over time, in which case the digital workstation can simply analyze that difference to produce dynamics. In other cases, control data may be interpreted with a detected baseline value so that the difference in motion, not the absolute position, is interpreted.

According to some embodiments, a Symphonist may wear and/or hold a device that may be activated to enable and disable processing of control data by the digital workstation. For example, the Symphonist may wear a touch sensitive device, or a device with a button. In some embodiments, the Symphonist may wear three rings on the same hand, such as the second, third and fourth fingers. When the three fingers are held together, the three rings may form a connection that sends a 'connected' signal (e.g., wirelessly) to digital workstation 120. The Symphonist may, in other implementations, wear the rings on other fingers, or use other solutions to have a functional switch, but the gesture of bringing the three fingers together may be convenient and matches a conventional cue for dynamics used with live musicians. The 'connected' signal may enable the processing of control data by the digital workstation so that the Symphonist is able to enable and disable said processing, respectively, by moving the rings to touch each other or by moving the rings apart. In some embodiments, this process of enabling and disabling processing may be applied to only a subset of the control data provided to the digital workstation. For instance, the rings may enable and disable processing of control data relating to dynamics whilst processing of control data relating to tempo continues regardless of the state of the rings.

The inventor has recognized and appreciated that it may be desirable for a Symphonist to have control over the dynamics of both groups of instruments and individual instruments. Although there are many possible technical solutions that would enable the Symphonist to select a group of instruments and then control the dynamic behavior, it is desirable that the solution be as unobtrusive as possible, both visually and in terms of the demand on the Symphonist to do anything that would not be part of conventional expectations of a conductor.

According to some embodiments, the Symphonist may wear and/or hold one or more devices that allow for control of a subset of the instrumental loudspeakers 130. The devices, when operated by the Symphonist, may provide a signal to the digital workstation that a particular subset of the instrumental loudspeakers is to instructed separately. Subsequent control signals may be directed exclusively to those instrumental loudspeakers. In some cases, the type of control signals so limited may be a subset of those provided by the Symphonist; for instance, by selecting a subset of the instrumental loudspeakers, tempo control data may be applied to music output by all of the instrumental loudspeakers, whilst dynamics control data may be applied only to music output to the selected subset. Devices suitable for control of a subset of the instrumental loudspeakers include devices with eye-tracking capabilities, such as eye-tracking glasses. When the Symphonist looks in a particular direction, for example, this may communicate to the system that instruments in a particular group (e.g., located in that direction with respect to the Symphonist) are to be controlled separately.

According to some embodiments, the digital workstation may provide feedback to the Symphonist that a subset of instrumental loudspeakers has been selected via visual cues, such as by a light or set of lights associated with a subset of instrumental loudspeakers that are lit by the digital workstation, and/or via a message on a display. In some cases, such visual cues may be visible only to the Symphonist, e.g., the visual cues may be displayed to an augmented reality (AG) device worn by the Symphonist and/or may be produced in a non-visible wavelength of light (e.g., infrared) made visible by a device worn by the Symphonist.

According to some embodiments, the musical score 122 may comprise MIDI (Musical Instrument Digital Interface) instructions and/or instructions defined by some other protocol for specifying a sequence of sounds. The sounds may include pre-recorded audio, sampled sounds, and/or synthesised sounds. Commonly, digital score software may be referred to as a 'Sequencer', a DAW (Digital Audio Workstation), or a Notation package. There are differences between these three types of software: a sequencer is intended mostly for MIDI scores, a notation package can be regarded as a word-processor for music (intended to be printed and handed to musicians), and a DAW is mostly for audio processing, although most recent DAWs include MIDI capabilities, and few dedicated MIDI sequencers remain in use. According to some embodiments, the digital workstation 120 may comprise a Digital Audio Workstation.

Irrespective of how the musical score of digital workstation 120 is implemented, the workstation is configured to produce acoustic data at a rate defined by a beat pattern of the musical score, an example of which is discussed below. The acoustic data may comprise analog audio signals (e.g., as would be provided to a conventional loudspeaker), digital audio signals (e.g., encoded audio in any suitable lossy or lossless audio format, such as AAC or MP3), and/or data configured to control a transducer of an instrumental loudspeaker to produce desired sound (examples of which are discussed below).

According to some embodiments, the musical score may comprise a plurality of beat points, each denoting a particular location in the musical score. These beat points may be periodically placed within the score, although they may also exhibit non-periodic placements. Control information received by the digital workstation relating to tempo is then used to trigger each beat point in turn. For instance, a spike in acceleration produced by an accelerometer-equipped baton may denote a beat as communicated by the Symphonist, and this may trigger a beat point in the score.

According to some embodiments, control data received from one or more devices by the digital workstation relating to tempo may indicate triggering of a beat point or may comprise sensor data that may be analyzed by the digital workstation to identify triggering of a beat point. That is, which particular device determines triggering of a beat point is not limited to the digital workstation, as any suitable device may determine triggering of a beat point based on sensor data. In preferred use cases, however, sensor devices may stream data to the digital workstation, which analyzes the data as it is received to detect when, and if, a beat point has been triggered.

According to some embodiments, in periods between beat points, the digital workstation may select an appropriate tempo and produce music according to the score at this tempo. This tempo may be selected based on, for example, the duration between the triggering of the previous two, three, etc. beat points. In some use cases, the tempo may be determined by fitting a curve to the timing distribution of beat points to detect whether the tempo is speeding up or slowing down. Once a tempo is selected by the digital workstation, the acoustic data is produced according to this tempo at least until a new determination of tempo is made. In some embodiments, a tempo is determined when every beat point is triggered based on the relative timing of that beat point to one or more of the previously received beat points.

According to some embodiments, control data received by the digital workstation during periods between beat points may provide additional information on tempo, and the digital workstation may, in some cases, adjust the tempo accordingly even though no new beat point has been triggered. For example, a Symphonist's baton moving up and down repeatedly may trigger a beat point due to quick motion at the bottom of the movement, though may also produce identifiable accelerometer data at the top of the movement. This "secondary" beat may be identified by the digital workstation and, based on the time between the primary beat point and the secondary beat, the digital workstation may determine whether to adjust the tempo. For example, if the time between the primary beat point and the secondary beat is less than half that of the time between the last two primary beat points, this suggests the tempo is speeding up. Similarly, if the time between the primary beat point and the secondary beat is greater than half that of the time between the last two primary beat points, this suggests the tempo is slowing down. Such information may be used between beat points to modify the current tempo at which acoustic data is being output by the digital workstation.

According to some embodiments, system 100 may include one or more devices (not shown in FIG. 1) for communicating tempo to live musicians. This communication may occur in addition to the conveyance of tempo by the Symphonist. The devices for communicating tempo to the live musicians may include devices that produce visual, audible and/or haptic feedback to the musicians. As examples of visual feedback, tempo in the form of a beat and/or in the form of music to be accompanied may be communicated to musicians by a flashing light (e.g., fixed to music-stands) and/or by a visual cue to augmented-reality glasses worn by the musicians. As examples of haptic feedback, tempo in the form of a beat may be communicated to musicians by a physically perceived vibration, which could, for instance, be effected through bone induction via a transducer placed in a suitable location, such as behind the ear, or built into chairs on which the musicians sit.

According to some embodiments, the digital workstation 120 may comprise one or more communication interfaces, which may include any suitable wired and/or wireless interfaces, for receiving sensor data from devices worn and/or held by the Symphonist 110 and/or from other devices capturing position or motion information of the Symphonist; and for transmitting acoustic data to the instrumental loudspeakers 130. In some cases, a device worn or held by the Symphonist may transmit control data to the digital workstation via a wireless protocol such as Bluetooth®.

As discussed above, instrumental loudspeakers 130 comprise actual acoustic instruments configured with one or more transducers and an appropriate interface to enable an audio signal of the specific instrument to be propagated by the acoustic instrument when it is induced to do so by the transducer. Each instrument class may have a different method to interface the transducer with the instrument, and in some cases, the instruments may be complimented with bending-wave resonating panel loudspeakers. According to some embodiments, a suitable transducer includes a so-called "DMD-type" transducer (such as described in U.S. Pat. No. 9,130,445, titled "Electromechanical Transducer with Non-Circular Voice Coil," which is hereby incorporated by reference in its entirety), but could alternatively be a standard voice-coil design. The instrumental loudspeakers may include, for example, numerous stringed and brass instruments in addition to a "vocal" loudspeaker designed to mimic the human voice. Illustrative examples of such devices are described in further detail below. As discussed above, acoustic data received by an instrumental loudspeaker may comprise analog audio, digital audio signals, and/or data configured to control a transducer of the instrumental loudspeaker Virtual acoustic loudspeaker 150 is an optional component of system 100 and may be provided to adjust the acoustics of the space in which system 100 is deployed. As discussed above, even with a combination of live musicians and instrumental loudspeakers, some performance spaces may nonetheless have inferior acoustics for orchestral music. One or more virtual acoustic loudspeakers may be placed within the performance space to control the acoustics to be, for example, more like that of a larger concert hall.

In particular, the inventor has recognized and appreciated that capturing ambient sound from a listening environment and rebroadcasting the ambient sound with added reverb through an appropriate sound radiator (e.g., a diffuse radiator loudspeaker) can cause a listener to become immersed in a presented acoustic environment by effectively altering the reverberance of the listening environment. Sounds originating from within the environment may be captured by one or more microphones (e.g., omni-directional microphones) and audio may thereafter be produced from a suitable loudspeaker within the environment to supplement the sounds and to give the effect of those sounds reverberating through the environment differently than they would otherwise.

According to some embodiments, virtual acoustic loudspeaker 150 may include one or more microphones and may rebroadcast the ambient sound of the performance space in which system 100 is located whilst adding reverb to the sound. Since the ambient sound may include music produced by one or more live musicians and one or more instrumental loudspeakers, the music produced by the system may be propagated in the performance space in a manner more like that of a desired performance space. This can be used, for example, to make sounds produced in a small room sound more like those same sounds were they produced in a concert hall.

According to some embodiments, virtual acoustic loudspeaker 150 may comprise one or more diffuse radiator loudspeakers. The use of diffuse radiator loudspeakers may provide numerous advantages over systems that use conventional direct radiator loudspeakers. Radiation may be produced from a diffuse radiator loudspeaker at multiple points on a panel, thereby producing dispersed, and in some cases, incoherent sound radiation. Accordingly, one panel loudspeaker may effectively provide multiple point sources that are decorrelated with each other.

Virtual acoustic loudspeakers may, according to some embodiments, include a microphone configured to capture ambient sound within a listening space; a diffuse radiator loudspeaker configured to produce incoherent sound waves; and/or a reverberation processing unit configured to apply reverberation to at least a portion of ambient sound captured by the at least one microphone, thereby producing modified sound, and output the modified sound into the listening space via the diffuse radiator loudspeaker. For instance, virtual acoustic loudspeakers within a Symphonova system may incorporate any suitable loudspeaker configuration as described in International Patent Publication No. WO2016042410, titled "Techniques for Acoustic Reverberance Control and Related Systems and Methods," which is hereby incorporated by reference in its entirety. Virtual Acoustics loudspeakers may also be referred to herein as acoustic panel loudspeakers or diffuse radiator loudspeakers.

According to some embodiments, the live musicians 140 may be playing instruments with one or more attached microphones and/or may be in proximity to one or more microphones. The microphone(s) may capture sound produced by the musician's instruments and transmit the sound to the digital workstation. This sound may be processed and output to any of various outputs, including the instrumental loudspeakers 130, as discussed further below.

In some embodiments, one or more of the live musicians 140 play an instrument coupled to both an acoustic microphone and a contact microphone. These microphones may be provided as a single combination microphone (e.g., in the same housing). Such a combination microphone may enable a method of receiving both the acoustic sound 'noise' of the instrument, as well as the resonant behavior of the instrument's body. As will be described below, an contact microphone may be used in the case of a string instrument to capture sounds suitable for production via a string instrumental loudspeaker. The contact microphone may transduce the behavior of the instrument, and not the sound of the instrument, whilst the physical behavior of the musician's instrument is then processed through the digital workstation, and output to a transducer that induces the same behavior in the body of the instrumental loudspeaker.

In view of the above description, it will be therefore seen that system 100 allows the Symphonist to produce music from one or more instrumental loudspeakers, thereby mimicking the playing of live instruments, by performing motions commensurate with those ordinarily employed by conductors. In addition, live musicians may optionally be present and playing music, and if so will receive instruction from the Symphonist in the conventional manner that a conductor would typically supply to the musicians. Moreover, by use of optional virtual acoustic loudspeakers, the acoustics of the performance space may be altered. These techniques have the potential to convincingly simulate a large orchestra within a large concert hall, even with a relatively small number of live musicians in a relatively small space.

It will be noted that, in some cases to be described further below, sound captured from a live musician such as by a microphone or other transducer attached to, or in close proximity to, their instrument may be captured and output from one or more instrumental loudspeakers. While this audio pathway is not illustrated in FIG. 1 for clarity, it will be appreciated that nothing about the illustrative system 100 is incompatible with this optional way to produce additional sound.

It should be appreciated that, in the example of FIG. 1, it is not a requirement that the Symphonist be located in the same physical location as any one or more other elements of system 100, and in general the described elements of FIG. 1 may be located in any number of different locations. For instance, the Symphonist may remotely conduct live musicians in another location; or a Symphonist may conduct live musicians in their location whilst instrumental loudspeakers producing sound are located in a different location.

Figure 2:
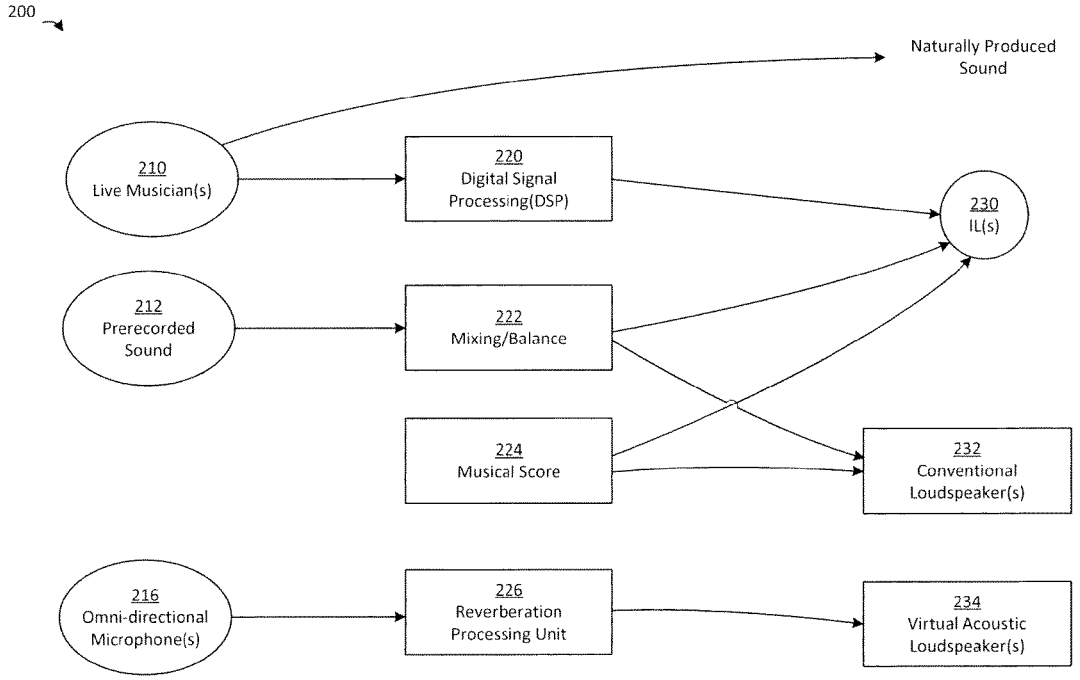
FIG. 2 is a block diagram illustrating acoustic inputs and outputs of an illustrative Symphonova system, according to some embodiments.

FIG. 2 is a block diagram illustrating acoustic inputs and outputs of an illustrative Symphonova system, according to some embodiments. Flowchart 200 is provided to depict the various acoustic pathways that can be included in an illustrative Symphonova system, wherein the illustrative system includes one or more live musicians 210, one or more instrumental loudspeakers 230, one or more conventional loudspeakers 232, one or more omni-directional microphones 216 and one or more virtual acoustic loudspeakers 234.

In the example of FIG. 2, each of the instrumental loudspeakers 230 receives acoustic data from one of three sources. First, sound produced by live musicians is captured via one or more microphones or other transducers. For example, in the case of a violin player, a contact microphone (such as the Schertler Dyn microphone) may be fixed onto the surface of the violin. Irrespective of how the sound is captured from a live musician, the sound may be split into multiple channels in digital signal processing (DSP) 220. DSP 220 may, in some embodiments, apply 'effects' processing to one or more of the channels (e.g., chorusing, delay, detune, alter the vibrato rate, or combinations thereof, etc.). Sound from each channel may then be sent to individual instrumental loudspeakers.

As an illustrative example, sound from a single live violin player may be captured and processed in sixteen channels by DSP 220, where different processing is applied to each channel to produce slightly different delay, chorusing, vibrato and/or detuning for each channel. Each of these channels may then be output to one of sixteen violin instrumental loudspeakers. In this manner, one live violin player may be made to sound like seventeen violins, where the subtle variations amongst the sound produced by the instrumental loudspeaker may aid in convincingly replicating the sound of seventeen live violins.

The second source of acoustic data supplied to the instrumental loudspeakers is prerecorded sound 212 that is mixed and/or balanced with the other sound sources in 222 and that may be output to an instrumental loudspeaker 230 (and/or to a conventional loudspeaker 232). The third source of acoustic data is a musical score 224 that may be controlled to produce acoustic data as described above in relation to FIG. 1, and output to an instrumental loudspeaker.

In the example of FIG. 2, therefore, the instrumental loudspeakers are used both to replicate and/or increase the sound produced by the one or more live musicians (who may or may not be physically co-located with the instrumental loudspeaker; that is, the performer may be in a separate and/or remote location); and to propagate sound that is recorded or sampled, or synthesized or modelled or a hybrid (such as a combination of sampling and modelling).

According to some embodiments, the digital musical score 224 may be configured to supply acoustic data to a plurality of instrumental loudspeakers on an independent basis. Even if a number of instrumental loudspeakers are of the same instrument type (e.g., violin), it may be beneficial to supply different acoustic data to each of the instrumental loudspeakers. As an illustrative example with reference to stringed instruments, it is frequently the case in an orchestra that one or more of the string sections is split into two (or more) parts, so that each sub-section plays different music. Although not very common in classical compositions, it is very common in romantic and subsequent orchestral writing. Referred to as 'divisi', it is clear that if a given Symphonova system has, for example, only five string players, being one for each main section: first violin, second violin, viola, cello and double bass, then without further sound production it is impossible for the musicians to play the divisi parts because only one player is present for each section. The instrumental loudspeakers 230 may be employed to allow production of divisi, however, by preparing the musical score 224 so that the divisi sections are included and performed by half of the instrumental loudspeakers in each section, as would be the case if the orchestra were composed only of live musicians.

According to some embodiments, the musical score 224 may be configured to define the volume of each independent channel output to the instrumental loudspeakers. For instance, when a divisi occurs the channels for the divisi instruments may be configured to produce different amplification from the instrumental loudspeakers than the remaining instrumental loudspeakers. The musical score may be configured thus based on the desired musical effect.

One further alternate situation may occur when one of the live musicians has a solo part, while the entirety of the rest of the musician's section plays different music. This can be accomplished through a similar process as the divisi—that is, the instrumental loudspeakers can be configured to produce music whilst the live musician plays something different. In the special case when the live player is meant to play alone, and the entire rest of the section is meant to be silent, this can be accomplished through means of automation in the musical score 224, or the live player could have a controller (e.g., a foot-switch or some other mechanism) for turning off the microphone associated with their instrument (or otherwise interrupting the microphone signal), so that there is no audio signal to be processed and thereby sent to the instrumental loudspeakers.

In the example of FIG. 2, the musical score 224 may also be output to one or more conventional loudspeaker(s) 232 in addition to the instrumental loudspeaker(s). Conventional loudspeakers may be used to propagate instruments for which there are unlikely to be Instrumental Loudspeakers (such as Japanese Taiko drums, Chinese gongs and Swiss Alp-horns), sounds for which there never will be instrumental loudspeakers (such as those created by a composer using electronic and/or digital means), and/or sounds for which an instrumental loudspeaker may never be available (such as 'special-effects,' e.g., a door closing, the sound of a galloping horse or a helicopter, etc.). In some embodiments, the conventional loudspeaker(s) 232 may be used to reproduce pre-recorded sound and/or electronically produced live music, such as from an electric guitar or an electronic synthesizer.

As a separate pathway in illustrative flowchart 200, ambient sound captured by the omni-directional microphone(s) 216 is processed through a reverberation processing unit 226 and output through one or more virtual acoustic loudspeakers. As discussed above, such loudspeakers may include one or more diffuse panel loudspeakers.

As an illustrative way to configured the virtual acoustic loudspeaker system, the following procedure may be followed. One or two omni-directional microphones may be placed in a suitable location in relation to the orchestra. If only one microphone is used, then the location may be selected to be in the left/right center, but near the front of the orchestra, pointing toward the ceiling, and as close to the ceiling as necessary to provide distance from the orchestra, but not so close to the ceiling as to receive any possible direct reflections. If two microphones are used, then they are suitably placed equidistant from each other and similarly positioned as the single microphone.

According to some embodiments, signal(s) from microphone(s) 216 may be processed in a suitable digital workstation as follows: high-quality reverberation (such as convolution reverberation) may be added to the signal, which is then split into sufficient channels for a number of virtual acoustic loudspeakers being used. Each channel is then allocated to and sent to one of the virtual acoustic loudspeakers. Delay and other effects may be added to each channel as necessary.

Note that, in the example of FIG. 2, no part of the musical score or other sound is sent directly to the virtual acoustic loudspeakers. This is a distinction from common practice in which music that is performed onstage is often processed through a digital reverberation effect, which is then blended and mixed with the original sounds, and all of which is then sent to the loudspeakers for propagation into the acoustic space. In illustrative process 200, the sound of the orchestra (whether from live musicians and/or instrumental loudspeakers), is ambiently received by the omni-directional microphone(s) 216 to be processed through the reverberation processing unit 226 and out the virtual acoustic loudspeakers as shown in the figure. There is no internal digital pathway. This makes the microphone(s) 216, the reverberation processing unit 226 and the virtual acoustic loudspeakers 234 a distinct system that works as an independent, free-standing acoustic processing system.

Figure 3:
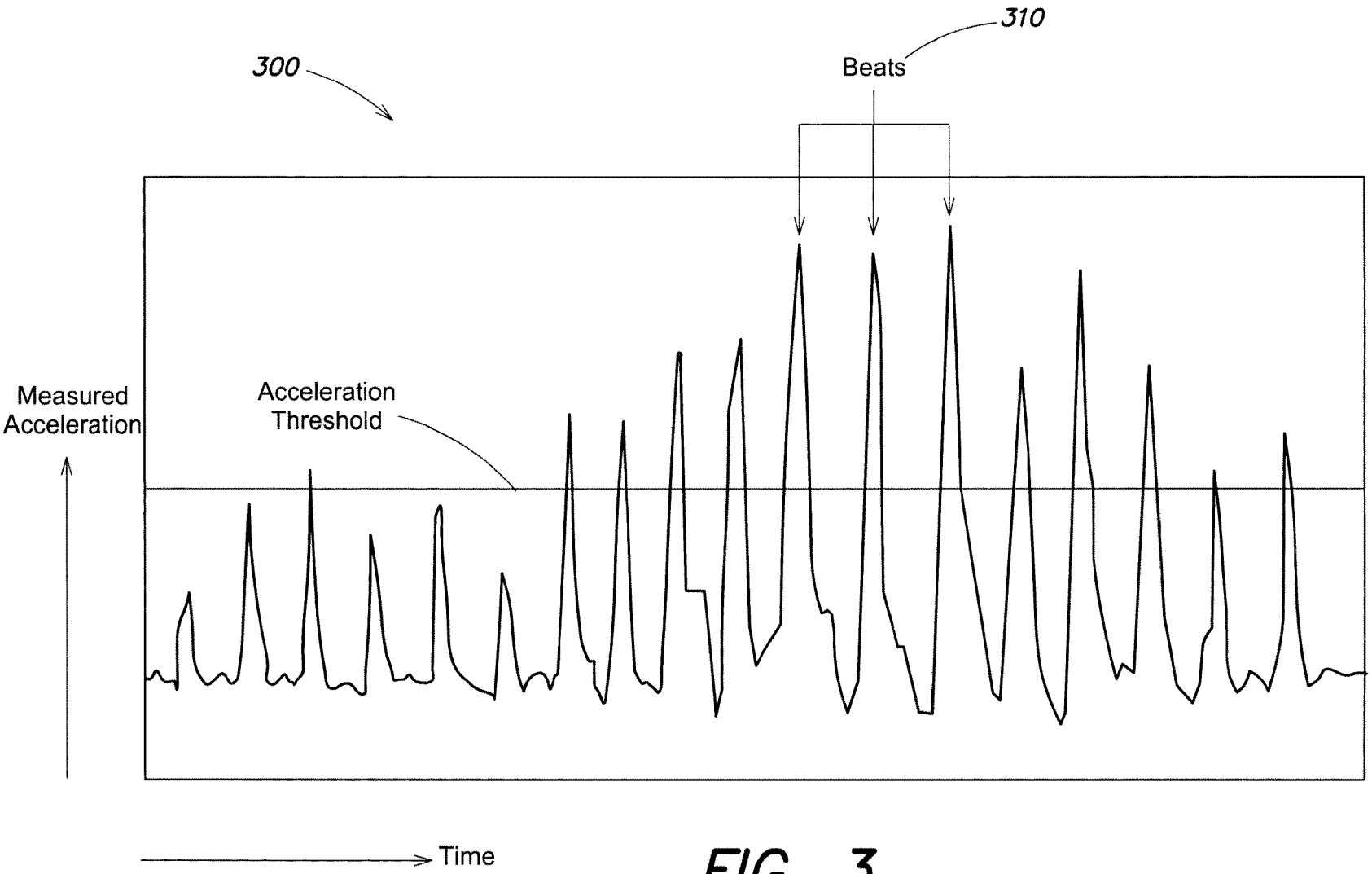
FIG. 3 is a chart illustrating data indicative of acceleration of a Symphonist device, according to some embodiments.

FIG. 3 is a chart illustrating data indicative of acceleration of a Symphonist device, according to some embodiments. Chart 300 illustrates data captured from a motion controller and is provided herein to illustrate one technique to identify beats based on motion data provided from a device. As described above, beats, once identified, may be used to trigger beat points in a musical score, which in turn may be used to produce acoustic data.

In the example of FIG. 3, an acceleration threshold has been selected, and a beat is detected when the acceleration passes above that threshold. Beats 310 are noted as three illustrative beats amongst those beats shown in FIG. 3. The data shown in FIG. 3 corresponds to a Symphonist conducting with a more or less steady tempo—that is, the time between beats is substantially the same throughout the period shown.

Figure 4:
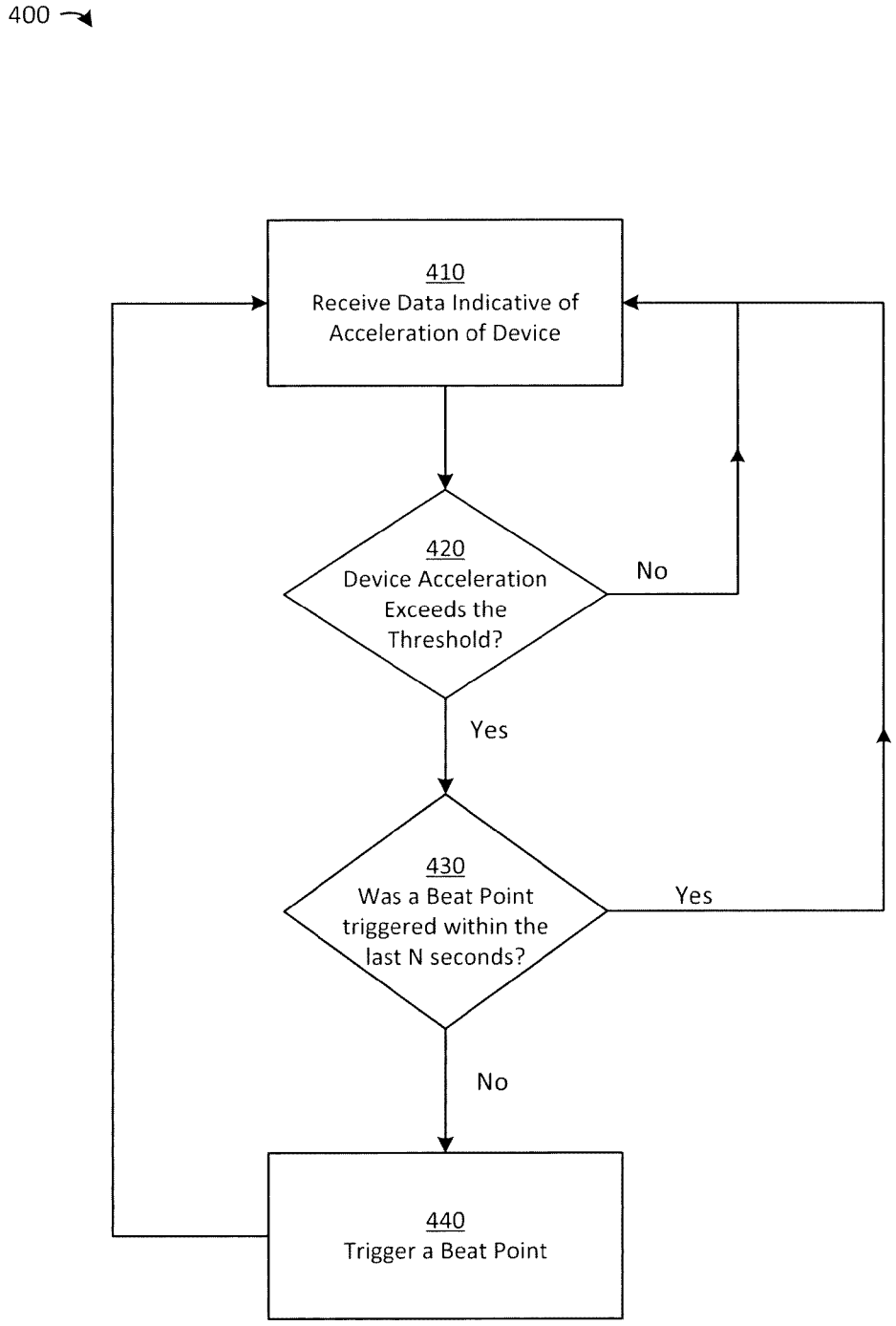
FIG. 4 is a flowchart of a method of triggering a beat point based on the motion of a Symphonist device, according to some embodiments.

FIG. 4 is a flowchart of a method of triggering a beat point based on the motion of a user device, according to some embodiments. Method 400 is an illustrative method of triggering a beat point based on the detection of a beat within control data generated by a Symphonist. In some embodiments, method 400 may be performed by a digital workstation, such as digital workstation 120 shown in FIG. 1, to trigger a beat point of a musical score. In some embodiments, method 400 may be performed by a user device held and/or worn by a Symphonist (or a device otherwise in communication with such a device) that detects a beat point and sends a trigger signal to another device, such as a digital workstation configured to play a musical score in accordance with received beat point triggers.

As shown in the above-discussed FIG. 3, accelerometer data may be used to identify a beat within sensor data generated by a Symphonist by detecting when the measured acceleration passes above a threshold. The inventor has recognized and appreciated, however, that an approach that utilizes only an acceleration threshold to detect a beat generally does not work for the following reasons.

In practice, a conductor's beat-point gesture is frequently complicated by various additional small movements which are easily ignored by musicians, but add sufficient noise so that it can be very difficult or impossible to extract the beat timing appropriately. One solution might be for the Symphonist to consistently make particularly strong beat-point gestures, so as to distinguish the desired rhythmic pulse from all other gestures. However, this is totally unacceptable as a method of conducting. For the Symphonist to direct musicians as would a conventional conductor, the Symphonist's gestures should include as close to the full gamut of possible strengths illustrated in a beat, including a movement that is perhaps no more than an extremely gentle tap with a range of arm and/or hand movement that does not exceed two or three centimeters.

Method 400 represents an approach to detecting a beat that allows the Symphonist's gestures to be as natural as those of a conventional conductor, and begins in act 410 in which the device performing method 400 receives data indicative of acceleration of a device held and/or worn by the Symphonist. As discussed above, such a device might include an accelerometer attached to, or secured within, a conductor's baton. According to some embodiments, the data received in act 410 may be received from a plurality of accelerometers so that the accuracy of beat detection may be improved by analyzing multiple acceleration measurements from the same or similar points in time.

In act 420, the device performing method 400 determines whether the acceleration indicated by the received data has passed a predetermined threshold. This threshold may be set for the duration of a musical performance, although in some cases the threshold may change during the performance (e.g., as directed by a digital musical score). In some embodiments, the predetermined threshold may be specifically chosen as the preferred value for a given Symphonist, as Symphonists may have different styles of movement that lend themselves to more sensitive (and therefore lower) threshold, or vice versa. Experiments have shown that less experienced conductors required a higher threshold of acceleration as they were less able to provide a clean beat with more gentle movements.

If the acceleration has not passed the threshold, method 400 returns to act 410. If the acceleration has passed the predetermined threshold, in act 430 it is determined whether a beat point has been triggered by the device performing method 400 within a previous time window. For instance, whether a beat point has been triggered within the past 0.5 seconds. According to some embodiments, the time window examined in act 430 may be selected based on expected rates of motion during conducting. That is, a conducting beat rate of 240 beats per minute is generally too fast for a conductor to move; it is certainly too fast for musicians to keep up. As such, a time window at least 250 milliseconds may be selected, as any repeated beats detected within 250 milliseconds of each other are very likely to include a spurious beat detection. When a beat would otherwise be detected due to measured acceleration exceeding an acceleration threshold, it is nonetheless ignored if it arrives too soon after a previous beat was detected. According to some embodiments, the time window may have a length that is between 200 milliseconds and 400 milliseconds, or between 250 milliseconds and 350 milliseconds, or around 300 milliseconds.

If in act 430 it is determined that no beat point was triggered within the time window, a beat point is triggered in act 440. For instance, the device executing method 400 may supply a beat point trigger to a sequencer or other software controlling a digital musical score. Method 400 then returns to act 410 to monitor the received data for another beat.

Figure 5:
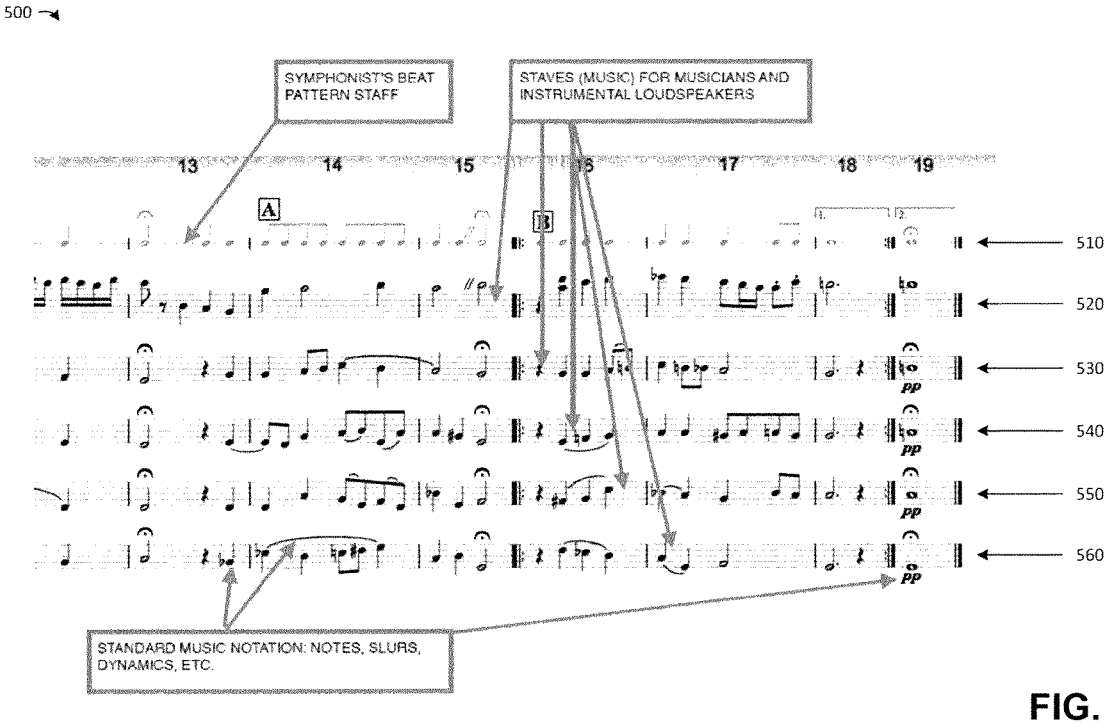
FIG. 5 is an illustrative musical score that includes a beat pattern to be followed by a Symphonist, according to some embodiments.

FIG. 5 is an illustrative musical score that includes a beat pattern to be followed by a Symphonist, according to some embodiments. Score 500 illustrates five channels of music to be produced from the score, labeled 520-560 in the figure, and a beat pattern 510 used to trigger production of acoustic data according to the score represented by the five channels. Score 500 is an illustrative visual example of a musical score 122 shown in FIG. 1.

As discussed above, beat points may be triggered according to received control data, which as seen from FIG. 5 allows the musical score to play through the notes shown in each of the five channels 520, 530, 540, 550 and 560 by selecting a tempo that is informed by the triggering of the beat points in beat pattern 510. It may be noted that in the beat pattern 510 the beats are not separated by equal durations; as such, it is expected that the Symphonist will conduct in a pattern matching that of the beat pattern. In other words, the illustrative beat pattern is defined under the assumption that it will be followed by the Symphonist. If it were not followed, the music would be played at a pace that it other than intended.

Figure 6A:
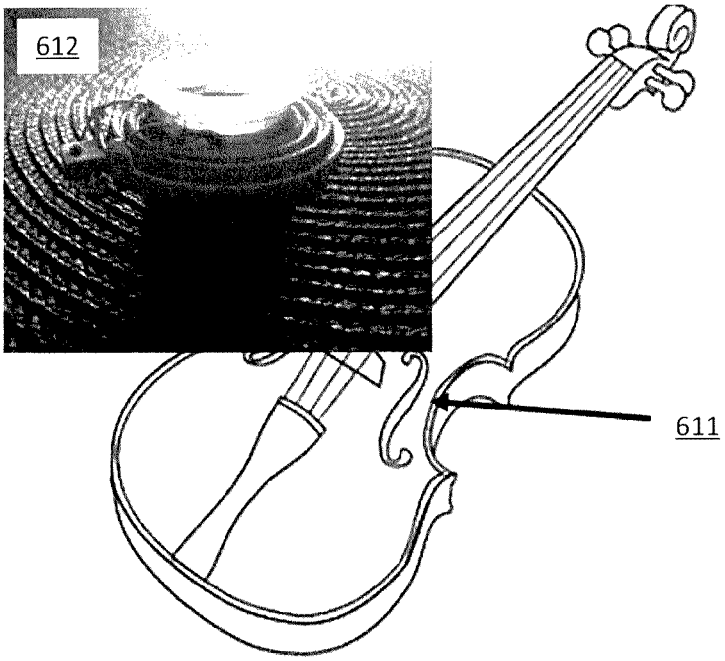
FIG. 6A depicts an illustrative configuration of an instrumental loudspeaker for a string instrument, according to some embodiments.

FIG. 6A depicts an illustrative configuration of an instrumental loudspeaker for a string instrument, according to some embodiments. A stringed instrument loudspeaker refers to any stringed instrument constructed with front and back plates. Examples include, without being limited, a violin, a viola, a cello, a double-bass, an acoustic guitar, an oud, a lute, a harp and a zither.

In the example of FIG. 6A, a drive unit 611 may be located at or near the sound post of the instrument, which is typically located slightly below the foot of the bridge near the E string on a violin. Inset 612 shows an illustrative drive unit so positioned. Depending on the size of the instrument body, there may be variations in the manner of installing the driver unit(s). For a small instrument such as a violin, a single driver unit may be sufficient. For a larger instrument such as a cello or double-bass, two drive units may be used.

FIGS. 6B-6E depict different driver configurations for the instrumental loudspeaker of FIG. 6A, according to some embodiments. Each of FIGS. 6B-6E depict a cross section through a string instrument and the mounting of a transducer to the instrument. In each of the examples of FIGS. 6B-6E, the sound point of the instrument has been removed to accommodate the transducer.

Figure 6B:
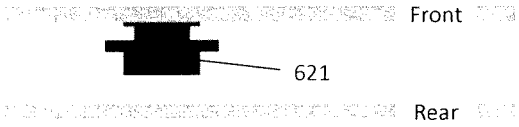
FIGS. 6B-6E depict different driver configurations for the instrumental loudspeaker of FIG. 6A, according to some embodiments.

In the example of FIG. 6B, a drive unit 621 is attached (e.g., glued) onto the interior face of the instrument's front plate.

Figure 6C:
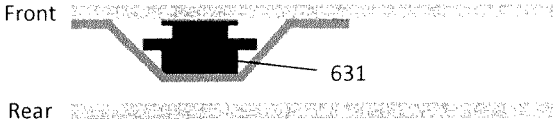

In the example of FIG. 6C, the transducer 631 is attached to the interior face of the instrument's front plate and a support member is placed behind the transducer for mechanical support. The support member may be, for example, a strip of neoprene rubber.

Figure 6D:
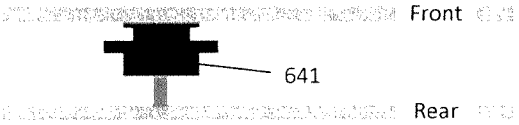

In the example of FIG. 6D, the transducer 641 is attached to the interior face of the instrument's front plate and a sound post is supplied to attached the transducer to the rear plate.

Figure 6E:
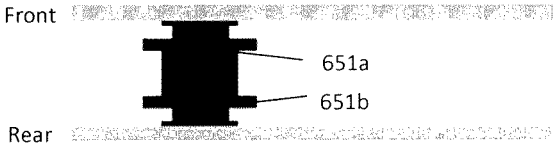

In the example of FIG. 6E, transducers 651*a* and 651*b* are attached to one another, back to back and attached to opposing interior surfaces of the instrument. In some embodiments, the two transducers are operated in phase with one another.

According to some embodiments, multiple transducers are included within a single instrument at different locations. Each location may utilize any of the configurations of FIGS. 6B-6E. In some implementations, the placement of the driver units may be in different quadrants of the instrument body. In one example, two driver units may be placed diagonally opposing each other across the instrument body. This puts the lower driver unit in a location that is lower and more to the right than if it were the only driver unit for the front plate. For example, larger instruments such as a viola, a cello and a double bass may use more than one transducer (driver). In another example, first and second transducers may be positioned on lower right and upper left quadrants of the front plate, respectively, and third and fourth transducers may be placed on the back plate of the instrument body, in positions corresponding to the first and second transducers.

A factor for determining the optimal location(s) of the driver unit(s) includes the equality of loudness across the largest possible chromatic scale of the instrument, which directly affects the timbre of the resultant sound. This may be determined, for example, by inputting sine-waves of salient frequencies through the driver unit(s) and measuring the frequency response of the instrument body.

Further functionality of instrument loudspeakers may be gained by including, within the instrument body, an amplifier to power the driver unit(s) and/or any suitable MIDI system. In the case of a cello, for example, the MIDI system may include a sampled cello library and appropriate software to trigger the samples (e.g., a sample player). In some implementations, a wireless connection may be included, for example, to adjust or trigger the sample-player in real-time. Acoustic data transmitted to the instrumental loudspeaker so equipped, as described above, may be configured to trigger the samples of such a MIDI system.

According to some embodiments, the instrument body may include a set of tuned strings, in order to improve the sound quality of the output acoustic signal (i.e., to better reproduce the instrument behavior of the musical instrument). This is not required, however, as an unstringed instrument may also be used as an instrumental loudspeaker.

In some implementations, it may be desirable to place one transducer at a location similar to a sound post in an actual stringed instrument, e.g., in the lower right quadrant of the front plate, off of the central horizontal and vertical axes. A single transducer at this location may be sufficient for a violin. In some implementations, a second transducer may also be positioned on the back plate of the instrument body (such as a violin body).

In some implementations, coupling of the driver unit(s) to the instrument body may cause both the front and back plates of the instrument body to vibrate. In one example, two transducers may be mechanically coupled to the respective front and back plates, in disparate locations (i.e., such that the two transducers are not mechanically coupled to each other). In another example, two transducers may be positioned back-to-back with each other and in contact with the respective front and back plates (as in FIG. 6E). In another example, a sound post may be positioned between the front transducer and the back plate, such that the front transducer also excites the back plate (as in FIG. 6D).

Figure 7:
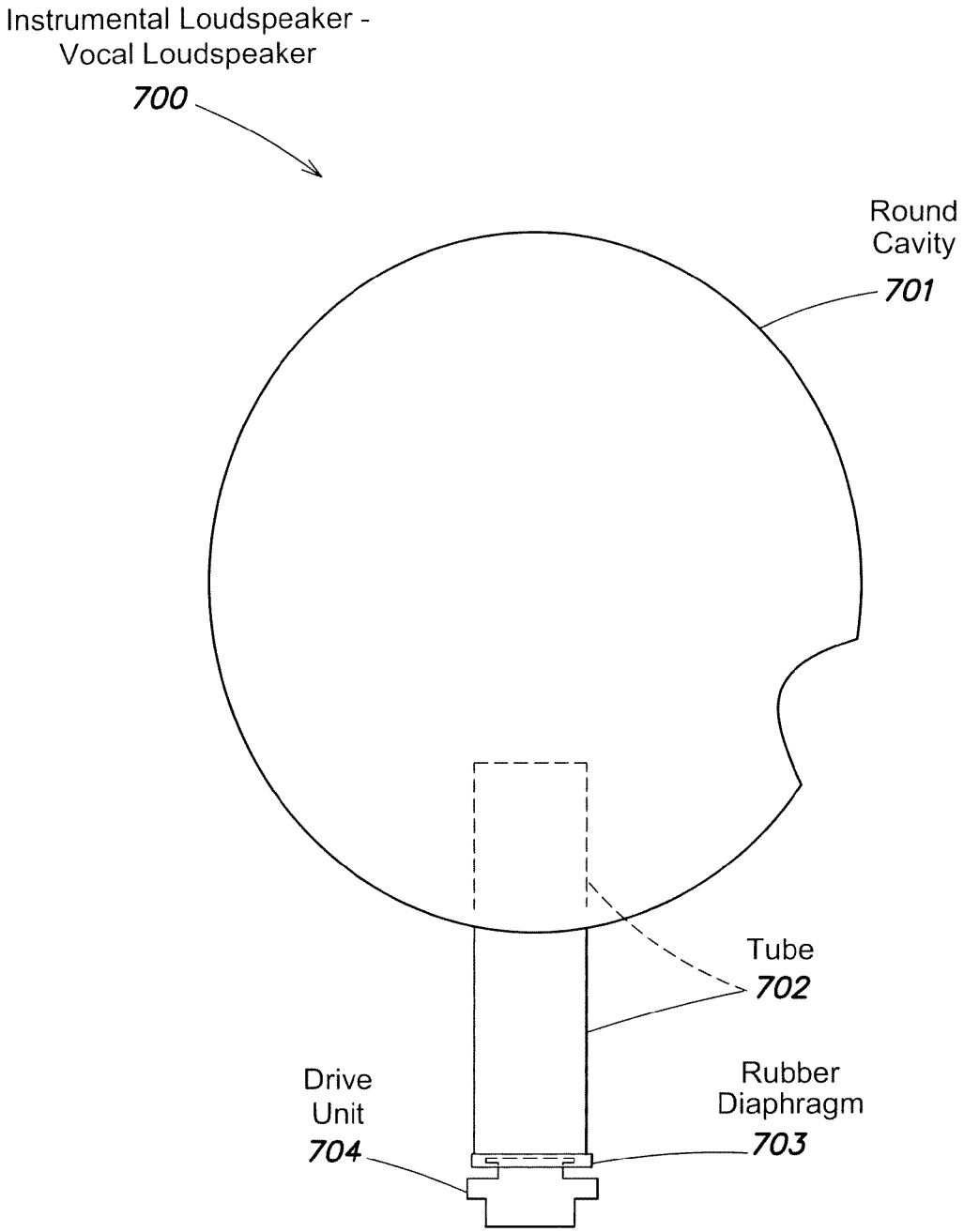
FIG. 7 depicts an illustrative configuration of a vocal loudspeaker, according to some embodiments.

FIG. 7 depicts an illustrative configuration of a vocal loudspeaker, according to some embodiments. Vocal loudspeaker 700 includes a spherical resonant cavity 701 and a tube 702, which together form a resonant chamber.

In the example of FIG. 7, a first transducer 704 is coupled to a taut rubber skin 703 pulled over the end of a tube 702. The tube length may be selected to reflect the average length of the pharynx (specifically the distance from the vocal folds to the lips) of the related voice. For low voices (e.g., bass or baritone in men, alto or mezzo in women), the tube may be between 17.5 cm and 20 cm long, with a diameter of 3 cm-5 cm. In high voices (e.g., tenor in men and soprano or coloratura in women), the tube length may be a little shorter (e.g., 15 cm-17.5 cm).

In the example of FIG. 7, the end of the tube is open and is inserted into a round (spherical) cavity (e.g., about the size of a human head). A seal may be formed between the tube and the round cavity. The round cavity includes an opening about the size of an open mouth. The placement of the opening may emulate the directionality of a human voice.

According to some embodiments, a flat panel loudspeaker (not pictured) may be used synchronously with the first transducer. In this case, the two methods of propagating sound may be operated in tandem and as a single unified loudspeaker. The flat panel loudspeaker may be configured to emulate the resonant behavior of the chest cavity, bones of the head and other human resonances that may not function on the basis of standing waves.

According to some embodiments, the resonant cavity 701 may house a MIDI unit and/or an amplifier (to drive the system). In some implementations, the 'front' face of the resonant chamber may be manufactured of a translucent but acoustically inert material. This would provide for a projector to be built into the chamber. When a remote individual is providing sound that is output from the vocal instrumental loudspeaker, a camera may monitor their face and transmit the moving image. The projector may provide the moving image of the remote singer in the performance location.

Figure 8:
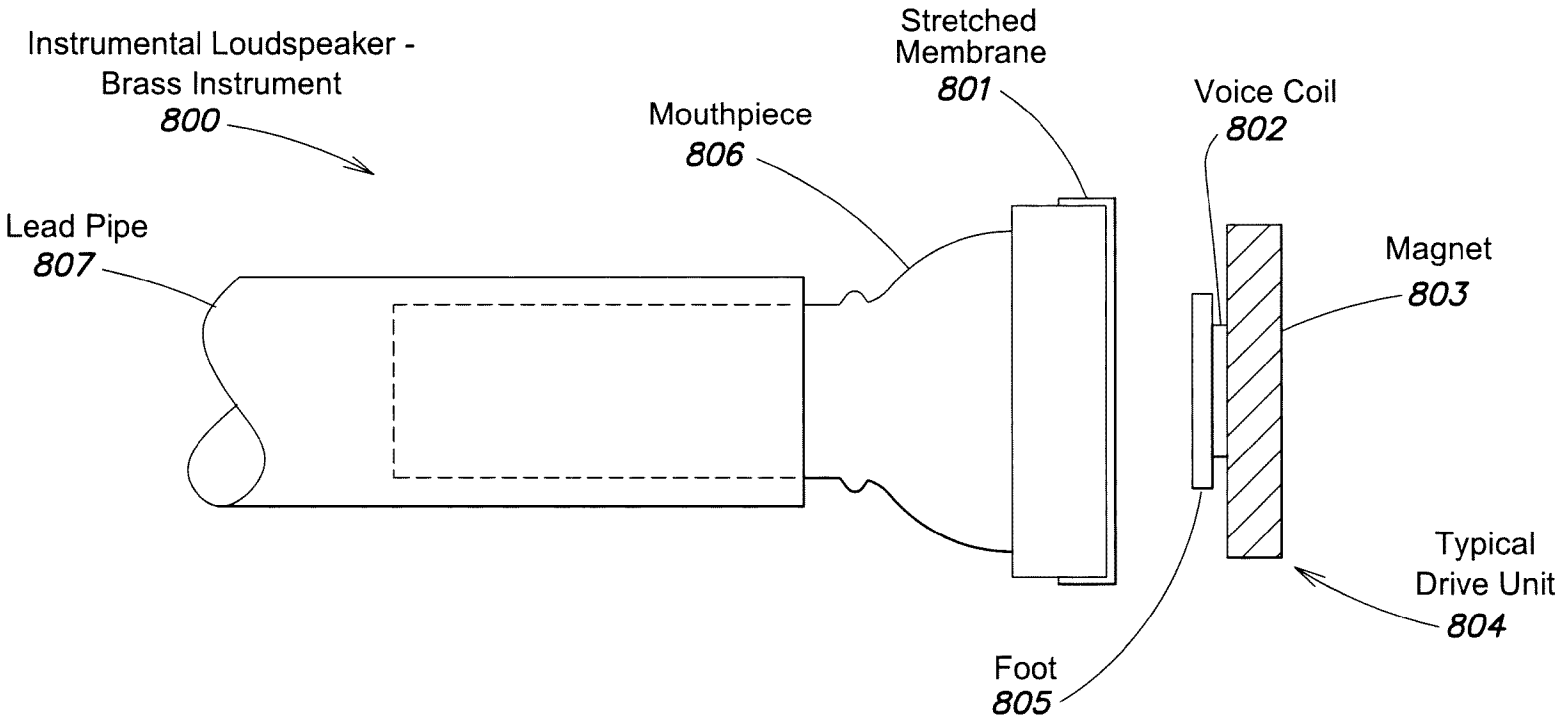
FIG. 8 depicts an illustrative configuration of an instrumental loudspeaker for a brass instrument, according to some embodiments.
Figure 9:
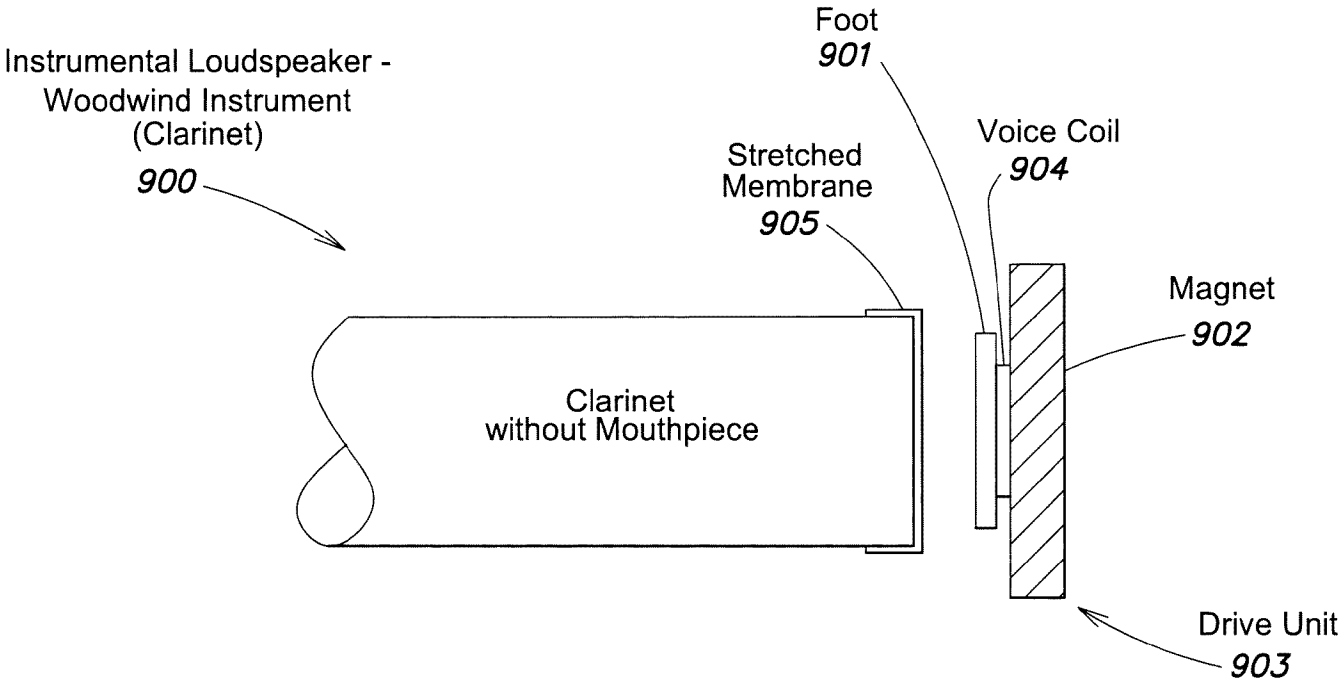
FIG. 9 depicts an illustrative configuration of an instrumental loudspeaker for a clarinet, according to some embodiments.
Figure 10:
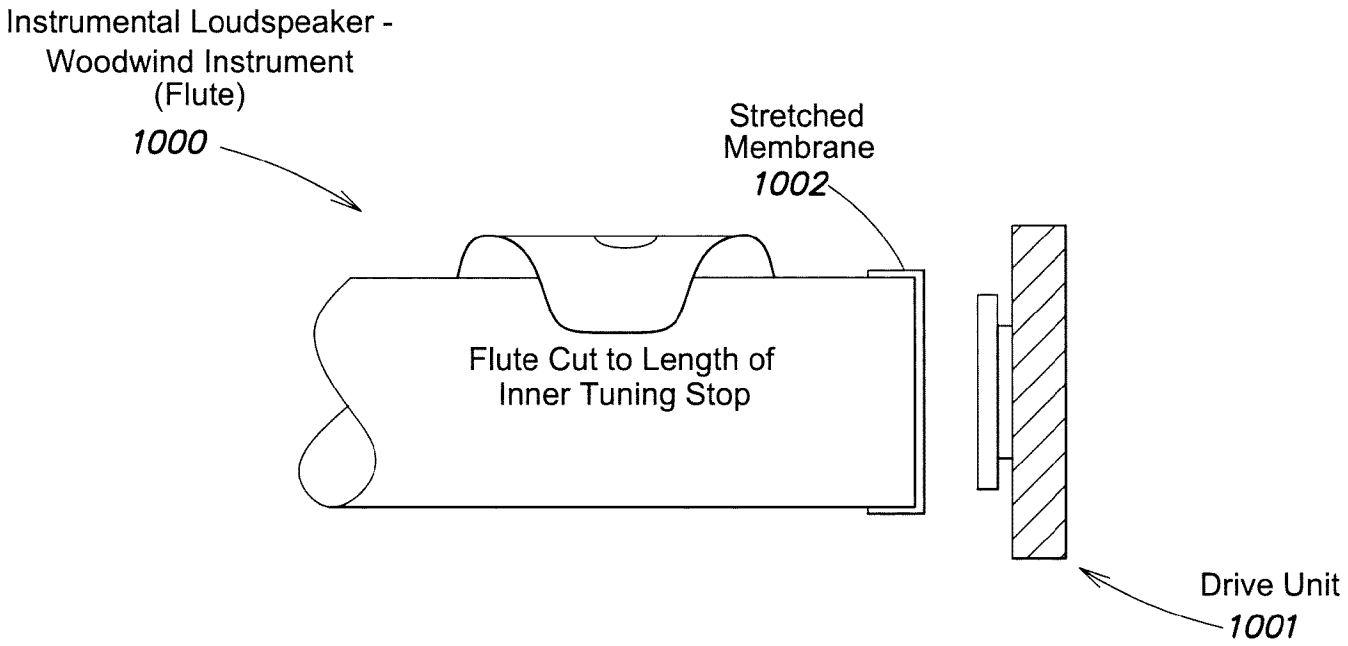
FIG. 10 depicts an illustrative configuration of an instrumental loudspeaker for a flute, according to some embodiments.

FIGS. 8-10 depicts illustrative configurations of instrumental loudspeakers for a brass and woodwind instruments, according to some embodiments.

When recording sound produced by a brass instrument, an acoustic microphone positioned close to the musical instrument may be used to record the standing waves of the musical instrument. To operate a brass instrument as an instrumental loudspeaker, such a recording may subsequently be used as the signal for a driver that would be embedded in the mouthpiece of the brass instrumental loudspeaker, in order to propagate the correct standing-wave in the instrument's body. The use of a brass instrument's mouthpiece in this regard is very desirable as the compression of the air in the cup of the mouthpiece, and the subsequent Venturi effect may contribute to a brass instrument's sound. For woodwind instruments, the mouthpiece may be discarded.

According to some embodiments, for brass instrument loudspeakers, the mouthpiece of a specific brass instrument (e.g., a trumpet mouthpiece for a trumpet as opposed to a trombone mouthpiece) may be used. The transducer may be small enough to be coupled to the mouthpiece, but may have sufficient impedance to accommodate high-power output. The transducer may be sealed over the mouthpiece. The keys of the instrument body (e.g., a trumpet) do not need to be depressed to enable all pitches to be reproduced. In some implementations, using a bass-trombone may enable the sound reproduction of other types of trombones in the trombone family (whereas a tenor trombone may not be capable of establishing the standing waves of a bass trombone).

In the example of FIG. 8, the lead pipe 807 is the tube of the brass instrument that would typically accept a mouthpiece. The mouthpiece is the part of the instrument that is pressed against the musician's lips. Contrary to the intuitive assumption about wind instruments (including the voice), sound is not a result of air-flow through the instrument. For example, in the case of a brass instrument, the reason for tightening the lips so that they buzz when the musician 'blows' air, is only to produce the buzz; it is not to create air-flow. The air-flow is incidental and is minimized by the best players. Once the buzzing lips are placed against and constrained by the mouthpiece, the vibrating lips cause a standing wave to occur within the tube of the brass instrument. The nature of the standing wave is determined by the length of the tube and the frequency of the buzzing lips; the standing wave is then colored by the instrument's material of construction, and finally amplified by the bell.

In the case of the instrumental loudspeaker shown in FIG. 8, a drive unit 804 (e.g., the magnet/voice-coil assembly of a typical loudspeaker, without the cone) may be attached to the instrument so that it can rest within the cup of the mouthpiece. For instance, the drive unit may be configured with a dome-shaped protrusion on the tip so that the dome can sit comfortably within the cup of the mouthpiece. A highly flexible, tear-resistant and thin material (e.g., a silicon rubber) may be stretched over the mouthpiece to form a membrane 801, and sealed so that no air escapes the cup of the mouthpiece, except through the pipe that is inserted into the lead-pipe of the instrument. The drive unit is then positioned against the stretched rubber so that the drive unit tip is within the cup of the mouthpiece. When an audio signal is sent to the drive unit, it moves and creates pressure/rarefaction in the cup of the mouthpiece. Because the audio signal is a recording of a brass instrument, the pressure/rarefaction in the cup of the brass instrument creates a suitable standing wave in the body of the instrument, and the natural sound of a brass instrument is perceived.

The above description of brass instruments also applies to the woodwind instrument in the example of FIG. 9, in that a drive unit 903 is similarly placed near to a membrane 905 stretched over the tube of the instrument. In a woodwind instrument, however, the head joint that holds the reed is removed and the transducer/membrane arrangement is positioned against the tube of the instrument. In the case of some instruments, such as an oboe or bassoon, an adapter may be desirable to properly attach the elements together. An alternative to an adapter may be to remove an end of the oboe, and in the case of the bassoon, to remove the entire mouthpiece/head joint assembly.

The above description of brass instruments is also applied to the flute shown in FIG. 10, in that a drive unit 1001 is similarly placed near to a membrane 1002 stretched over the tube of the instrument. A flute produces a standing wave in the manner of a Helmholtz resonator. The air-flow out the musician's mouth is directed across the hole in the mouthpiece such that the air flow flips from a direction that is across the top of the hole, and into the hole. The flipping up and down is due to the change in pressure and is the result of the standing wave which is established because of the resonant behavior/characteristic of the tube. The resonant frequencies are determined by the air-speed delivered by the musician, and the length/configuration of the tube as a result of the open/closed keys. The flute instrumental loudspeaker shown in FIG. 10 includes the membrane/drive unit assembly at the end of the tube and the hole of the mouthpiece is sealed. In some embodiments, sound produced by a flute instrumental loudspeaker may be enhanced by combining its output with that of a resonating panel loudspeaker playing the same sound (this may enhance the sound because the panel provides the element of the flute sound which is normally contributed by the resonant behavior of the musician's chest and head).

Figure 11A:
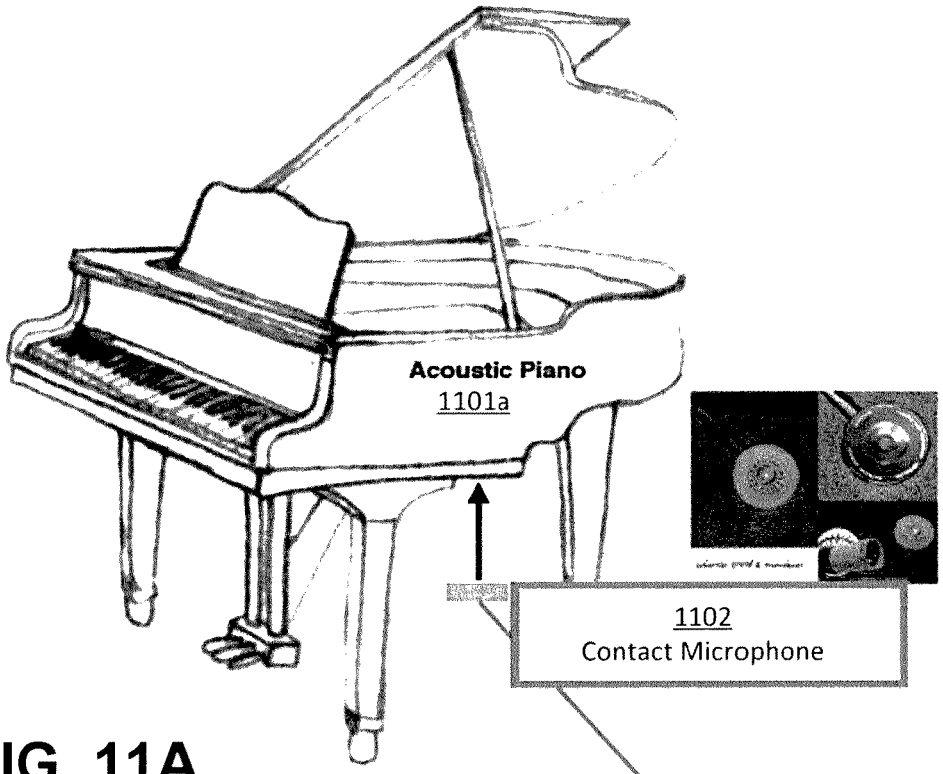
FIGS. 11A-11B depict illustrative configurations of an instrumental loudspeaker for a piano, according to some embodiments.
Figure 11B:
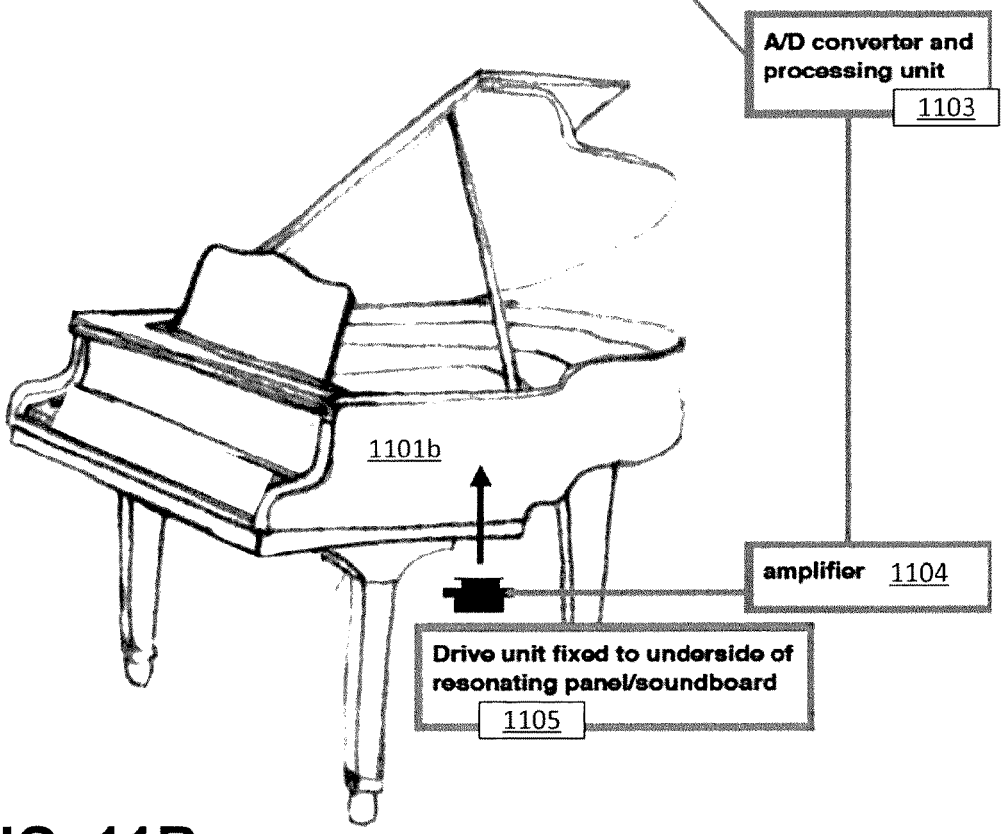

FIGS. 11A-11B depict illustrative configurations of an instrumental loudspeaker for a piano, according to some embodiments. In the example of FIG. 11A, the acoustic piano 1101*a* includes a contact microphone 1102 mechanically coupled to the body of the piano. This configuration may be used to record (capture) audio signals produced by the piano. In some embodiments, the recorded audio signal may also capture the dynamic behavior of hammers, dampers and strings (as captured by acoustic microphone(s) positioned close to one or more of these mechanisms).

In the example of FIG. 11B, an amplifier and drive unit 1105 are fixed to the underside of the resonating panel of the piano 1101. This configuration may be used during performance to reproduce the original piano behavior as captured by the acoustic piano 1101*b* shown in FIG. 11A. A conversion and processing unit 1103 may convert the captured audio signals into instructions to reproduce the sound via the pictured driver and amplifier 1104-5. In this illustrative configuration, one or more drivers 1105 are mechanically coupled to the soundboard of the instrument loudspeaker. Generally, the soundboard in an actual piano does not normally fill the entire space of the piano. In an upright piano, it is only a portion of the vertical box, and in a grand piano, the part of the case nearest the keys is consumed by the pin-block. In some use cases, a piano loudspeaker, may include no pin-block, harp or strings, so the soundboard may fill the entire interior of the case.

According to some embodiments, a piano instrumental loudspeaker includes a piano cabinet devoid of other components (e.g., pin-block, harp, action) except for a standard piano soundboard built into it, end to end. One or more transducers may be mechanically coupled to the soundboard. To save space, the instrument loudspeaker may be oriented such that it stands on its side or 'keyboard' edge. In this orientation, the loudspeaker may be placed in proximity to a wall at a similar distance to a normal piano floor distance (e.g., about 1 m).

According to some embodiments, a piano instrumental loudspeaker includes the full harp and strings of a real piano, but lacks dampers and pedals. Instead, one or more thin strips of felt are threaded between the strings to ensure the resonance of the strings is slightly damped and does not continue without check (without reducing the string resonance to the point that the strings are prevented from ringing). In some implementations, a string resonance of approximately 3 sec may be desirable. Alternatively to the string resonance, an algorithm to add string-resonance may be included in processing of the audio signal.

Figure 12A:
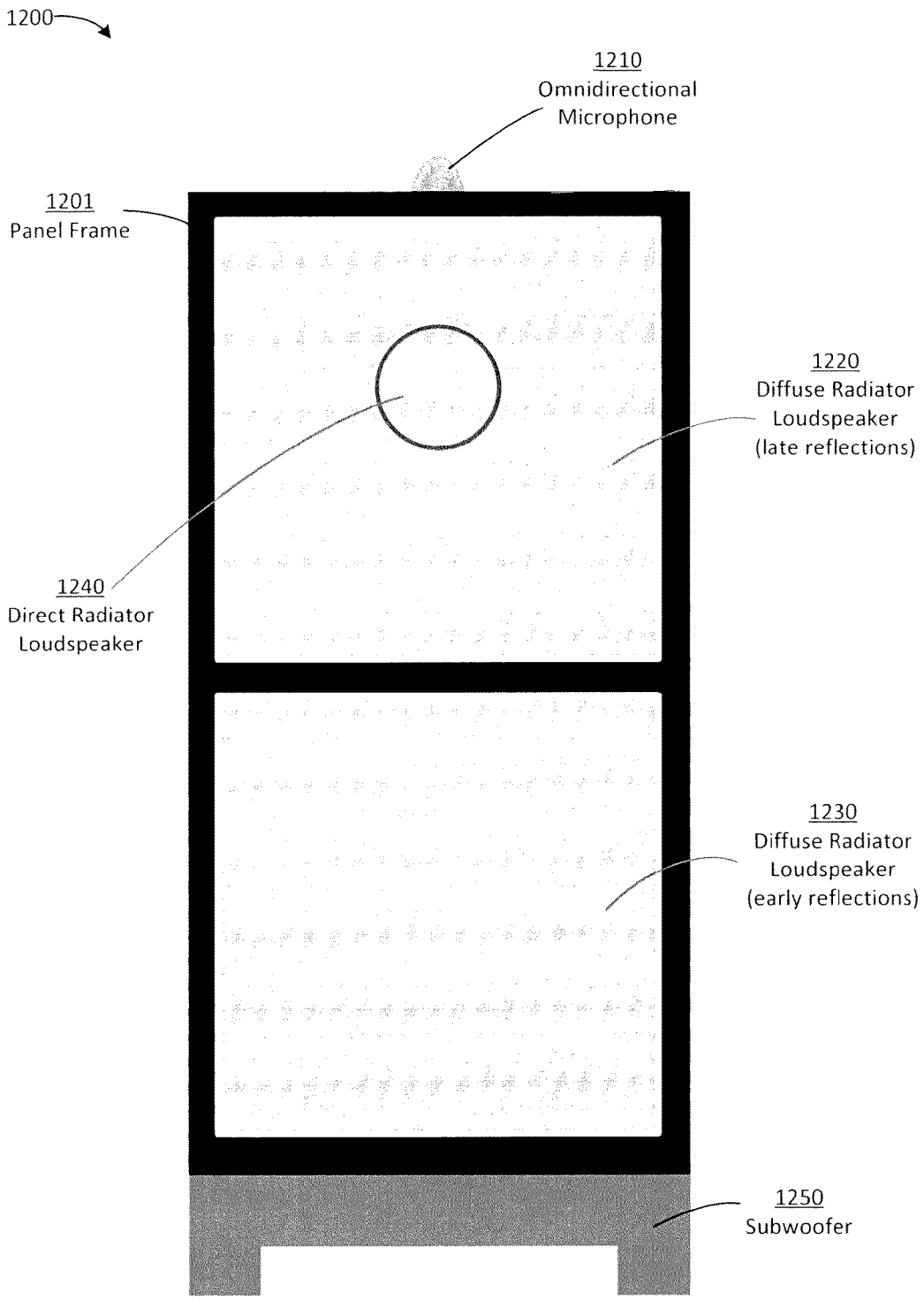
FIGS. 12A-12C depict an illustrative virtual acoustic audio system, according to some embodiments.
Figure 12B:
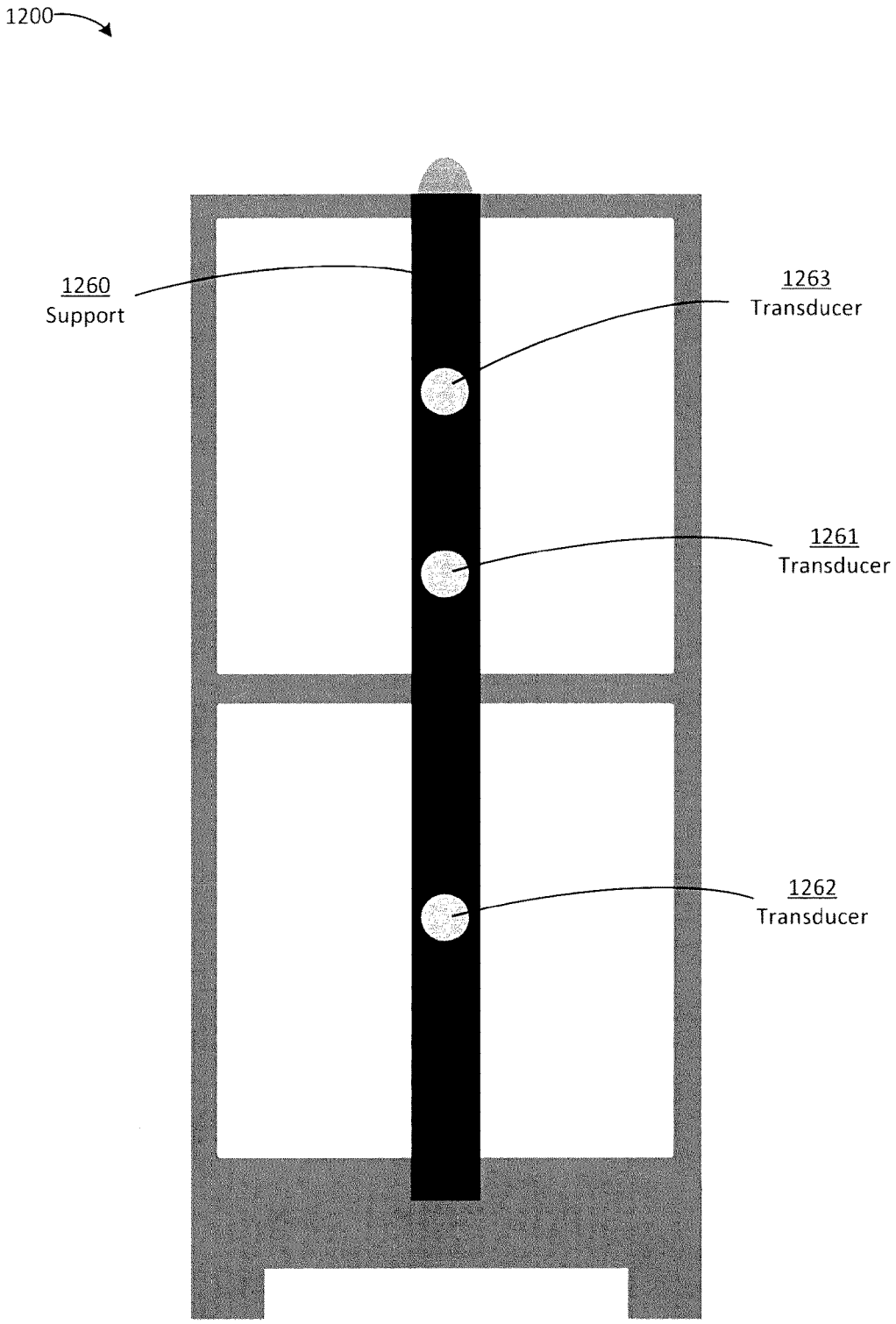
Figure 12C:
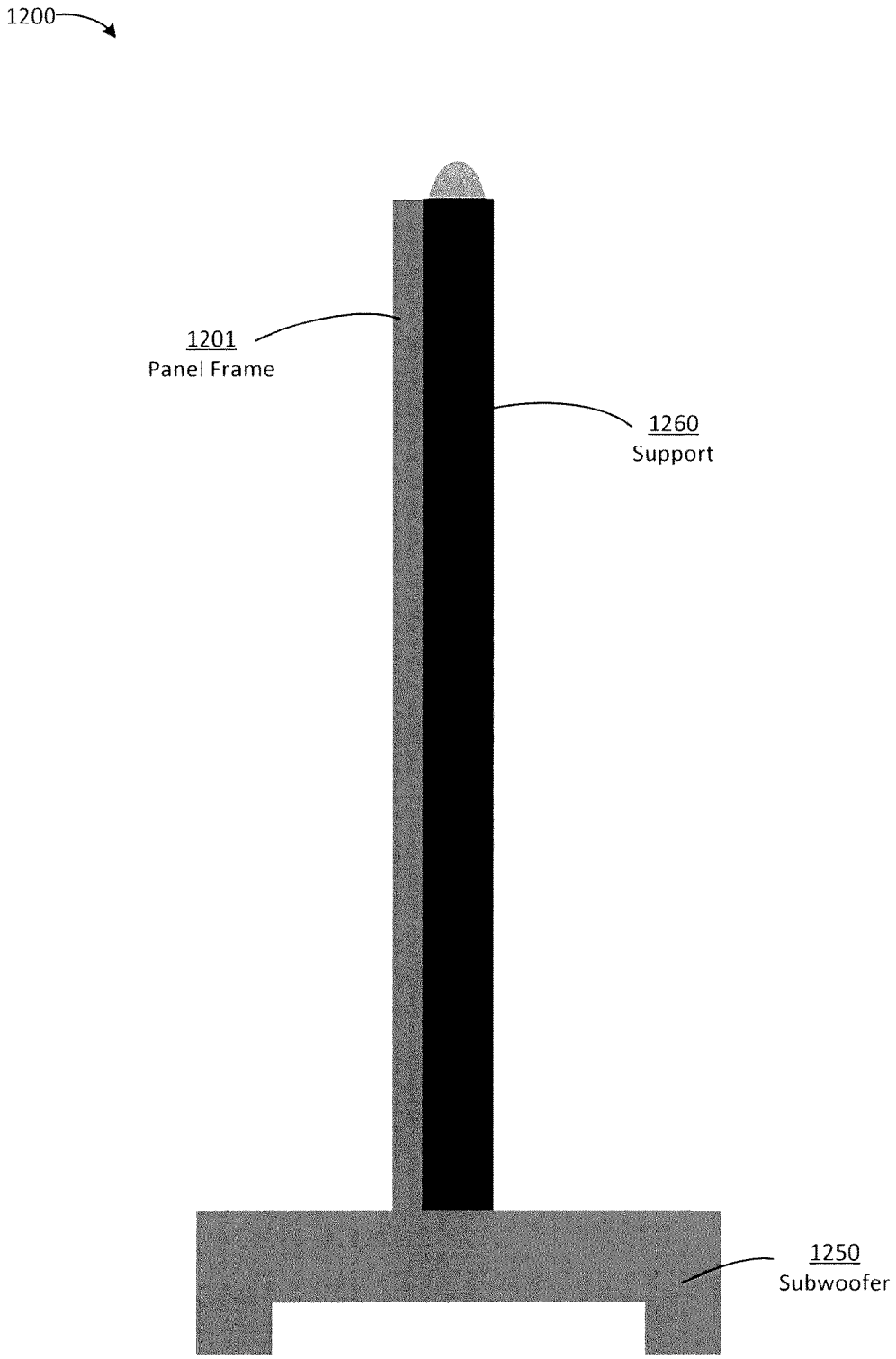

FIGS. 12A-12C depict an illustrative virtual acoustic audio system, according to some embodiments. FIG. 12A depicts a front face view of the housing, FIG. 12B depicts a front face view with the front panel removed, and FIG. 12C depicts a side view. Any number of components of the above-described systems may be incorporated within the housing 1200, several of which are identified in the figures. In some embodiments, one or more subsystems, such as an active reverberation enhancement system and/or an audio processing subsystem, may be disposed within the depicted housing. In some embodiments, one or more of such subsystems may be connected to components within the housing via any number of wired or wireless connections.

In the example of FIG. 12A, an upper section of the panel includes a circular portion cut out of the diffuse radiator loudspeaker 1220 to produce the direct radiator loudspeaker 1240. The panel within the cut out portion that acts as direct radiator loudspeaker 1240 may have been stiffened relative to the panel of diffuse radiator loudspeaker 1220 so that it functions as a coherent radiation source. In some embodiments, the direct radiator loudspeaker 1240 may include a collar to reduce air-turbulence and/or to improve bass response. A gap between diffuse radiator loudspeaker 1220 and direct radiator loudspeaker 1240 may, for example, be around 2 mm.

In the example of FIG. 12B, a support 1260 provides structure sufficient to hold transducers (and possibly wires connected to those transducers) of the loudspeakers 1220, 1230 and 1240. Transducers 1261, 1262 and 1263 correspond to loudspeakers 1220, 1230 and 1240, respectively.

According to some embodiments, diffuse radiator loudspeakers 1220 and/or 1230 may be configured to produce incoherent sound. For instance, either or both speakers may exhibit an IACC coefficient of below 0.7, below 0.5, etc.

Figure 13:
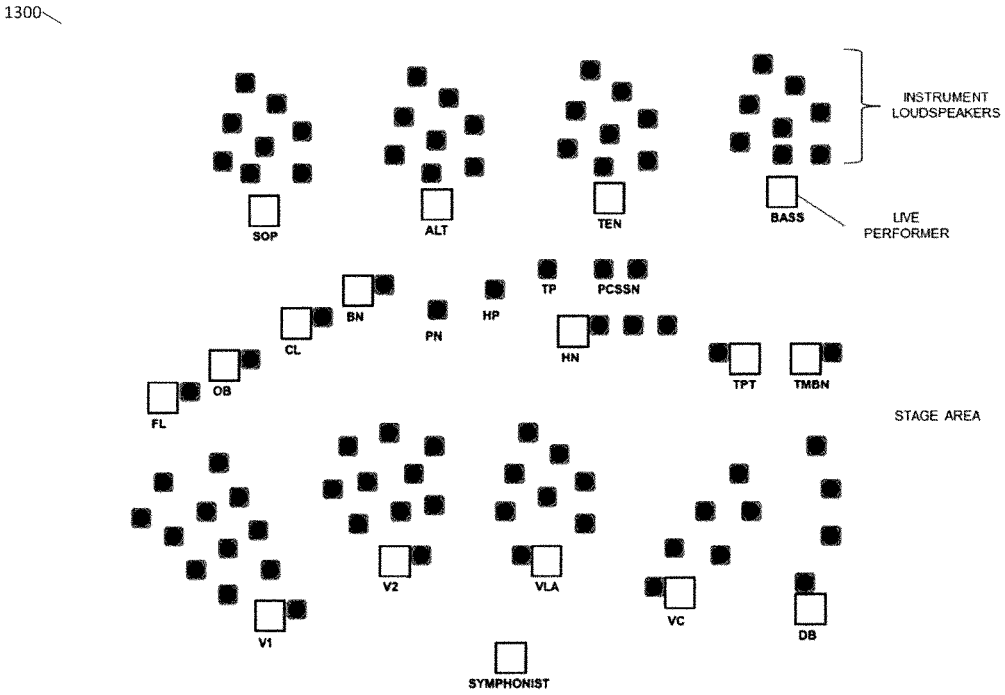
FIG. 13 depicts an illustrative orchestral configuration for a Symphonova system featuring sixteen live musicians, according to some embodiments.

FIG. 13 depicts an illustrative orchestral configuration for a Symphonova system featuring sixteen live musicians, according to some embodiments. FIG. 13 illustrates one illustrative configuration in which, with only sixteen live musicians (shown as large, light gray squares in the figure) and a suitable number of instrument loudspeakers (shown as small, dark gray squares in the figure), a Symphonist may direct live musicians and produce sound approximating that of a full orchestra.

Figure 14:
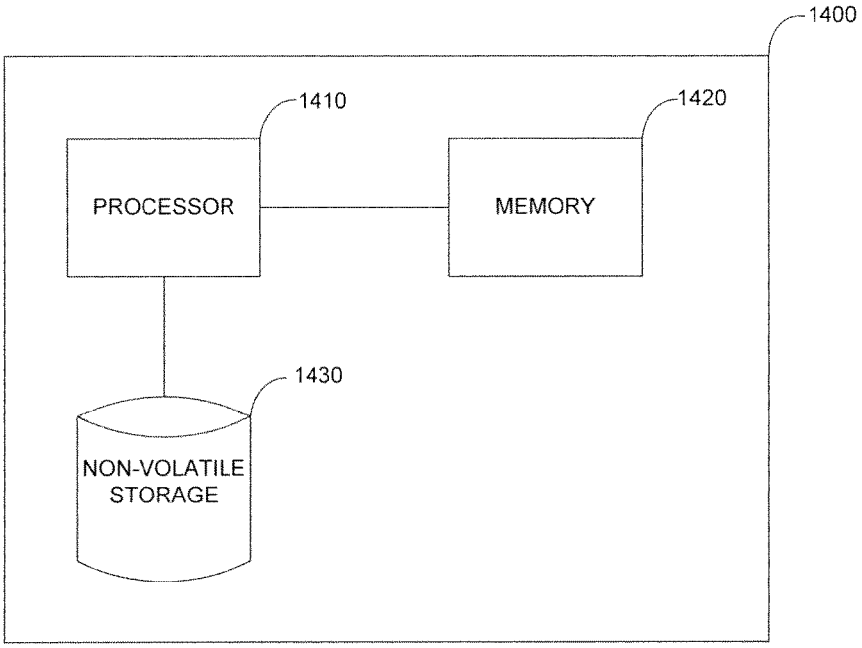
FIG. 14 illustrates an example of a computing system environment on which aspects of the invention may be implemented.

An illustrative implementation of a computer system 1400 that may be used to implement one or more of operations such as detecting a beat within control data supplied by a Symphonist, and/or producing acoustic data in accordance with a digital musical score is shown in FIG. 14. The computer system 1400 may include one or more processors 1410 and one or more non-transitory computer-readable storage media (e.g., memory 1420 and one or more non-volatile storage media 1430). The processor 1410 may control writing data to and reading data from the memory 1420 and the non-volatile storage device 1430 in any suitable manner, as the aspects of the invention described herein are not limited in this respect. To perform functionality and/or techniques described herein, the processor 1410 may execute one or more instructions stored in one or more computer-readable storage media (e.g., the memory 1420, storage media, etc.), which may serve as non-transitory computer-readable storage media storing instructions for execution by the processor 1410.

In connection with techniques described herein, code used to, for example, receive accelerometer data, detect beats, generate beat triggers, and/or produce acoustic data according to a musical score may be stored on one or more computer-readable storage media of computer system 1400. Processor 1410 may execute any such code to provide any techniques for production of music as described herein. Any other software, programs or instructions described herein may also be stored and executed by computer system 1400. It will be appreciated that computer code may be applied to any aspects of methods and techniques described herein. For example, computer code may be applied to interact with an operating system to configure a digital musical score.

The various methods or processes outlined herein may be coded as software that is executable on one or more processors that employ any one of a variety of operating systems or platforms. Additionally, such software may be written using any of numerous suitable programming languages and/or programming or scripting tools, and also may be compiled as executable machine language code or intermediate code that is executed on a virtual machine or a suitable framework.

In this respect, various inventive concepts may be embodied as at least one non-transitory computer readable storage medium (e.g., a computer memory, one or more floppy discs, compact discs, optical discs, magnetic tapes, flash memories, circuit configurations in Field Programmable Gate Arrays or other semiconductor devices, etc.) encoded with one or more programs that, when executed on one or more computers or other processors, implement the various embodiments of the present invention. The non-transitory computer-readable medium or media may be transportable, such that the program or programs stored thereon may be loaded onto any computer resource to implement various aspects of the present invention as discussed above.

The terms "program," "software," and/or "application" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion among different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in non-transitory computer-readable storage media in any suitable form. Data structures may have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Various inventive concepts may be embodied as one or more methods, of which examples have been provided. The acts performed as part of a method may be ordered in any suitable way. Accordingly, embodiments may be constructed in which acts are performed in an order different than illustrated, which may include performing some acts simultaneously, even though shown as sequential acts in illustrative embodiments.

The indefinite articles "a" and "an," as used herein in the specification and in the claims, unless clearly indicated to the contrary, should be understood to mean "at least one." As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. An apparatus for controlling the production of music, the apparatus comprising: at least one processor; and at least one processor-readable storage medium comprising processer-executable instructions that, when executed, cause the at least one processor to:

receive data indicative of acceleration of a user device;

detect whether the acceleration of the user device has exceeded a predetermined threshold based at least in part on the received data;

determine whether a beat point has been triggered by the apparatus within a prior period of time; and trigger a beat point when the acceleration of the user device is detected to have exceeded the predetermined threshold and when no beat point is determined to have been triggered during the prior period of time.

2. The apparatus of claim 1, wherein the processor-executable instructions, when executed by the at least one processor, further cause the at least one processor to generate acoustic data according to a digital musical score in response to the beat point trigger.

3. The apparatus of claim 2, wherein a tempo of the acoustic data generated according to the digital musical score is determined based at least in part on a period of time between triggering of a previous beat point and said triggering of the beat point.

4. The apparatus of claim 2, wherein generating the acoustic data according to the musical score comprises:

identifying an instrument type associated with a portion of the musical score; and generating the acoustic data based at least in part on the identified instrument type.

5. The apparatus of claim 4, wherein the processor-executable instructions, when executed by the at least one processor, further cause the at least one processor to output the generated acoustic data to one or more instrumental loudspeakers of the identified instrument type.

6. The apparatus of claim 2, wherein the processor-executable instructions, when executed by the at least one processor, further cause the at least one processor to output the generated acoustic data to one or more loudspeakers.

7. The apparatus of claim 1, wherein the prior period of time is a period of between 200 ms and 400 ms immediately prior to said determination of whether the beat point has been triggered.

8. The apparatus of claim 1, further comprising at least one wireless communication interface configured to receive said data indicative of acceleration of the user device.

9. An orchestral system, comprising:

a plurality of instrumental loudspeakers, each instrumental loudspeaker comprising an acoustic musical instrument comprising at least one transducer configured to receive acoustic signals and to produce audible sound from the musical instrument in accordance with the acoustic signals;

a computing device comprising:

at least one computer readable medium storing a musical score comprising a plurality of sequence markers that each indicate a time at which playing of one or more associated sounds is to begin; and at least one processor configured to:

receive beat information from an external device;

generate, based at least in part on the received beat information, acoustic signals in accordance with the digital score by triggering one or more of the sequence markers of the musical score and producing the acoustic signals as corresponding to one or more sounds associated with the triggered one or more sequence markers; and provide the acoustic signals to one or more of the plurality of instrumental loudspeakers;

at least one microphone configured to capture ambient sound within a listening space;

a diffuse radiator loudspeaker configured to produce incoherent sound waves; and a reverberation processing unit configured to:

apply reverberation to at least a portion of ambient sound captured by the at least one microphone, thereby producing modified sound; and output the modified sound into the listening space via the diffuse radiator loudspeaker.

10. The orchestral system of claim 9, wherein the at least one processor is configured to generate the acoustic signals based at least in part on instrument types associated with the one or more sounds of the musical score.

11. The orchestral system of claim 9, wherein the plurality of instrumental loudspeakers includes at least a first instrument type, and wherein the at least one processor is configured to generate the acoustic signals provided to the instrumental loudspeakers of the first instrument type based at least in part on one or more sounds of the musical score associated with the first instrument type.

12. The orchestral system of claim 9, further comprising one or more second microphones, distinct from the at least one microphone configured to capture ambient sound within the listening space, configured to capture audio and supply the audio to the computing device, and wherein the at least one processor of the computing device is further configured to receive the captured audio and provide the captured audio to one or more of the plurality of instrumental loudspeakers.

13. The orchestral system of claim 12, wherein the one or more second microphones are mounted to one or more acoustic musical instruments, and wherein the at least one processor of the computing device is further configured to perform digital signal processing upon the captured audio before providing the captured audio to the one or more of the plurality of instrumental loudspeakers.

14. The orchestral system of claim 9, wherein the at least one processor of the computing device is further configured to output a prerecorded audio recording to one or more of the plurality of instrumental loudspeakers.

15. A method of controlling the production of music, the method comprising:

receiving, by an apparatus, data indicative of acceleration of a user device;

detecting, by the apparatus, that the acceleration of the user device has exceeded a predetermined threshold based at least in part on the received data;

determining, by the apparatus, that no beat point has been triggered by the apparatus for at least a first period of time; and triggering, by the apparatus, a beat point in response to said detecting that the acceleration of the user device has exceeded the predetermined threshold and said determining that no beat point has been triggered for at least the first period of time.

16. The method of claim 15, further comprising generating, by the apparatus, acoustic data according to a digital musical score in response to the beat point trigger.

17. The method of claim 16, further comprising producing sound from one or more instrumental loudspeakers according to the generated acoustic data, wherein the one or more instrumental loudspeakers are each an acoustic musical instrument comprising at least one transducer configured to receive acoustic signals and to produce audible sound from the musical instrument in accordance with the acoustic signals.

18. The method of claim 15, wherein the first period of time is between 200 ms and 400 ms.

* * * * *